US010912691B2

(12) United States Patent
Cherny et al.

(10) Patent No.: US 10,912,691 B2
(45) Date of Patent: Feb. 9, 2021

(54) CONFIGURABLE ASSISTIVE DEVICE

(71) Applicant: 9302204 CANADA INC., Richmond Hill (CA)

(72) Inventors: Eugene Cherny, Richmond Hill (CA); Evelio Goderich, Markham (CA); Dmitry Paltsev, Toronto (CA); Gennadiy Lisnyak, Richmond Hill (CA)

(73) Assignee: 9302204 CANADA INC., Richmond Hill (CA)

( * ) Notice: Subject to any disclaimer, the term of this patent is extended or adjusted under 35 U.S.C. 154(b) by 236 days.

(21) Appl. No.: 16/076,771

(22) PCT Filed: Feb. 13, 2017

(86) PCT No.: PCT/IB2017/050795

§ 371 (c)(1),
(2) Date: Aug. 9, 2018

(87) PCT Pub. No.: WO2017/137967

PCT Pub. Date: Aug. 17, 2017

(65) Prior Publication Data

US 2019/0038487 A1 Feb. 7, 2019

Related U.S. Application Data

(60) Provisional application No. 62/294,644, filed on Feb. 12, 2016.

(51) Int. Cl.

| | |
|---|---|
| ***A61G 5/10*** | (2006.01) |
| ***A61G 5/04*** | (2013.01) |
| ***A61G 5/12*** | (2006.01) |
| ***A61G 5/08*** | (2006.01) |
| ***A61G 5/00*** | (2006.01) |

(52) U.S. Cl.
CPC ..... *A61G 5/104* (2013.01); *A61G 5/006* (2013.01); *A61G 5/045* (2013.01); *A61G 5/085* (2016.11);

(Continued)

(58) Field of Classification Search
CPC .... A61G 5/104; A61G 5/1056; A61G 5/1059; A61G 5/1075
See application file for complete search history.

(56) References Cited

U.S. PATENT DOCUMENTS 6,112,843 A * 9/2000 Wilcox ..... B60K 17/36 180/209
7,100,718 B2 * 9/2006 Bancroft ..... A61G 5/042 180/65.1

(Continued)

FOREIGN PATENT DOCUMENTS

WO WO-2016006248 A1 * 1/2016 ..... A61G 5/06

OTHER PUBLICATIONS

ISA/CA, International Preliminary Report on Patentability (Ch. 1), dated Aug. 14, 2018, re PCT International Patent Application No. PCT/IB2017/050795.

(Continued)

*Primary Examiner* — James A English
(74) *Attorney, Agent, or Firm* — PatentFile, LLC; Bradley C. Fach; Steven R. Kick

(57) ABSTRACT

A configurable assistive device comprising: a platform; at least three wheels; and, at least three independent leg mechanisms, each respective leg mechanism coupled to the platform and a respective one of the at least three wheels, each respective leg mechanism configured to move the platform relative to the respective wheel for positioning the (Continued)

platform at an elevation and for inclining the platform to an inclination to configure the assistive device into one of a plurality of configurations.

20 Claims, 23 Drawing Sheets

(52) U.S. Cl.
CPC ..... *A61G 5/0866* (2016.11); *A61G 5/1059* (2013.01); *A61G 5/1067* (2013.01); *A61G 5/1075* (2013.01); *A61G 5/1078* (2016.11); *A61G 5/1091* (2016.11); *A61G 5/121* (2016.11); *A61G 5/125* (2016.11); *A61G 5/127* (2016.11); *A61G 5/128* (2016.11); *A61G 5/042* (2013.01); *A61G 2203/14* (2013.01)

(56) References Cited

U.S. PATENT DOCUMENTS 8,672,065 B2 * 3/2014 Beck ..... B60K 7/0007 180/24
9,682,603 B2 * 6/2017 Richter ..... B60G 99/002
2004/0168839 A1 9/2004 Wu
2008/0097256 A1 4/2008 Torres et al.
2010/0301576 A1 * 12/2010 Dugas ..... A61G 5/1078 280/104
2011/0227314 A1 * 9/2011 Lowenthal ..... A61G 5/0883 280/304.1
2014/0262566 A1 9/2014 Davis et al.
2014/0265181 A1 * 9/2014 Lambarth ..... A61G 7/0513 280/28.5
2015/0231002 A1 * 8/2015 Gierse ..... A61G 5/1059 297/344.16
2016/0120715 A1 5/2016 Farmer
2017/0172823 A1 * 6/2017 Ishikawa ..... A61G 5/042

OTHER PUBLICATIONS

International Search Report dated Apr. 13, 2017 for PCT International Application No. PCT/IB2017/050795.
Written Opinion of the International Searching Authority dated Apr. 13, 2017 for PCT International Application No. PCT/IB2017/050795.

* cited by examiner

CONFIGURABLE ASSISTIVE DEVICE

CROSS-REFERENCE TO RELATED APPLICATIONS

This application claims priority to U.S. provisional application 62/294,644, filed Feb. 12, 2016, which is incorporated herein by reference.

FIELD

The present disclosure relates generally to assistive devices. More particularly, the present invention relates to an assistive device that is configurable into a plurality of different configurations for the everyday needs of people.

BACKGROUND

Mobility impaired and elderly people currently use several different assistive devices for their everyday needs. Such people may use a wheelchair for transportation, a ceiling lift or a standing lift or an easy track for climbing stairs, and other devices to move over rough surfaces or obstacles or for other everyday needs. Purchasing several different assistive devices can be costly. Also, transferring between different assistive devices can be complicated and difficult for some people, including mobility impaired and elderly people.

SUMMARY

The present disclosure generally relates to a configurable assistive device that obviates the need to purchase several different assistive devices and reduces the likelihood risk of trauma to a person and/or a caregiver while transferring the person from one assistive device to another assistive device.

An aspect of the present disclosure provides an assistive device that includes a platform; at least three wheels; and, at least three independent leg mechanisms, each respective leg mechanism coupled to the platform and a respective one of the at least three wheels, each respective leg mechanism configured to move the platform relative to the respective wheel for positioning the platform at an elevation and for inclining the platform to an inclination to configure the assistive device into one of a plurality of configurations.

Each respective leg mechanism may be configured to move between an open position to increase a distance between the platform and the respective wheel, and a closed position to reduce the distance between the platform and the respective wheel.

The assistive device may further comprise: a control system configured to independently control the at least three independent leg mechanisms for positioning the platform at the elevation (e.g. a desired or predetermined height from a surface on which the leg mechanisms rest) and for inclining the platform to an inclination (e.g. a desired or predetermined angle relative to the surface) by controlling a distance between the platform and each respective leg mechanism to configure the assistive device into one of the plurality of configurations.

The assistive device may further include a gyroscopic sensor configured to detect a change in a horizontal level of the platform, and the control system may be further configured to move one or more of the at least three independent leg mechanisms to self-level the assistive device while ascending or descending an inclined surface.

The at least three wheels may include a front wheel and two rear wheels.

The front wheel may be a caster wheel and the two rear wheels may be drive wheels.

The at least three independent leg mechanisms may comprise: a front leg mechanism coupled to the front wheel and configured to move at least one of a front of the platform, a first side of the platform, and a second side of the platform opposing the first side of the platform relative to the front wheel; a first rear leg mechanism coupled to a first rear wheel of the two rear wheels, the first rear leg mechanism configured to move at least one of a back of the platform, and the first side of the platform relative to the first rear wheel; and a second rear leg mechanism coupled to a second rear wheel of the two rear wheels, the second rear leg mechanism configured to move at least one of the back of the platform, and the second side of the platform relative to the second rear wheel.

The at least three wheels may include a front wheel and two rear wheels.

The at least three wheels may include two front wheels and a rear wheel.

The at least three wheels may include two front wheels and two rear wheels.

The two front wheels may be caster wheels and the two rear wheels may be drive wheels.

Each wheel of the at least three wheels may be a drive wheel.

The at least three independent leg mechanisms may comprise: a first front leg mechanism coupled to a first front wheel of the two rear wheels, the first front leg mechanism configured to move at least one of a front of the platform, and a first side of the platform relative to the first front wheel; a second front leg mechanism coupled to a second front wheel of the two rear wheels, the second front leg mechanism configured to move at least one of the front of the platform, and a second side of the platform opposing the first side relative to the first front wheel; a first rear leg mechanism coupled to a first rear wheel of the two rear wheels, the first rear leg mechanism configured to move at least one of a back of the platform, and the first side of the platform relative to the first rear wheel; and a second rear leg mechanism coupled to a second rear wheel of the two rear wheels, the second rear leg mechanism configured to move at least one of the back of the platform, and the second side of the platform relative to the second rear wheel.

The assistive device may further comprise a seat cushion mounted to the platform.

The assistive device may further comprise a backrest attached to the platform proximate a back of the platform, the backrest for supporting a back user when the user is seated on the seat cushion.

The backrest may be pivotally attached to the platform and moveable between a collapsed position in which a front face of the backrest lies on the seat, and a fully-flat position in which the backrest is substantially horizontal and extends from the seat cushion.

The assistive device may further comprise a leg assembly attached to a front of the platform for supporting legs of a user when the user is seated on the seat cushion.

The leg assembly may be pivotally attached to the front of the platform and moveable between a first position in which the leg rest assembly extends substantially vertically from a bottom of the platform and a second position in which the leg rest assembly extends substantially horizontally from a front of the platform.

The leg assembly may comprise a foot rest for supporting at least one foot of the user when the user is seated on the seat cushion.

The leg assembly may further comprise one or more calf supports coupled to the foot rest, each of the one or more calf supports configured to support a calf of a leg of the user when the user is seated on the seat cushion.

The assistive device may further comprise at least one armrest mounted to the platform for supporting at least one arm of a user and for inhibiting the user from falling out of the assistive device when the user is seated on the seat.

The at least one armrest may comprise a pair of collapsible armrests including a first collapsible armrest mounted to a top of the platform proximate a left side of the platform and a second collapsible armrest mounted to the top of the platform proximate a right side of the platform.

BRIEF DESCRIPTION OF THE DRAWINGS

Embodiments of the present invention will be described, by way of example, with reference to the drawings and to the following description, in which.

DETAILED DESCRIPTION

Figure 1:
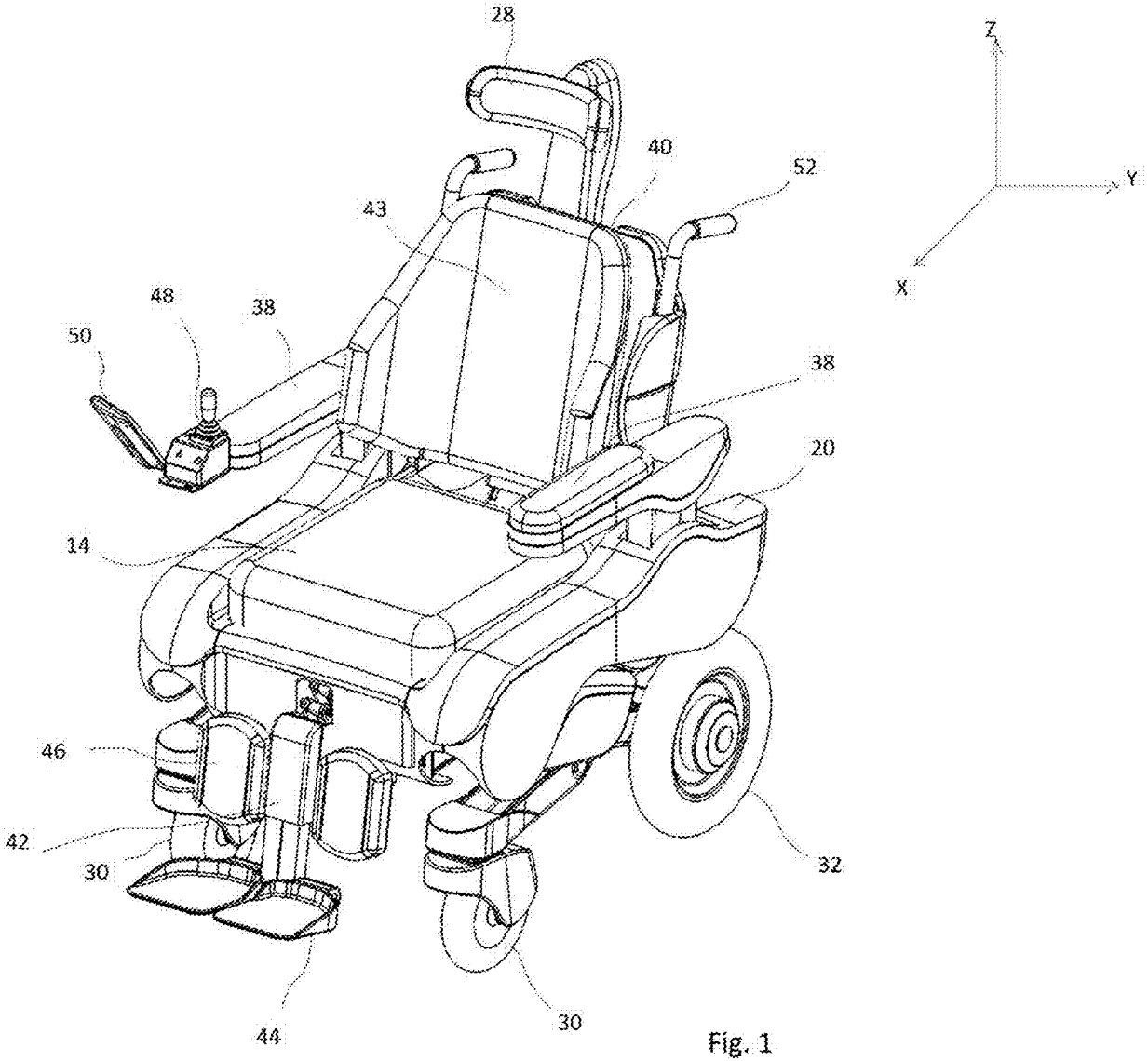
FIG. 1 is a perspective view from above of an assistive device in accordance with an embodiment of the present disclosure.
Figure 2:
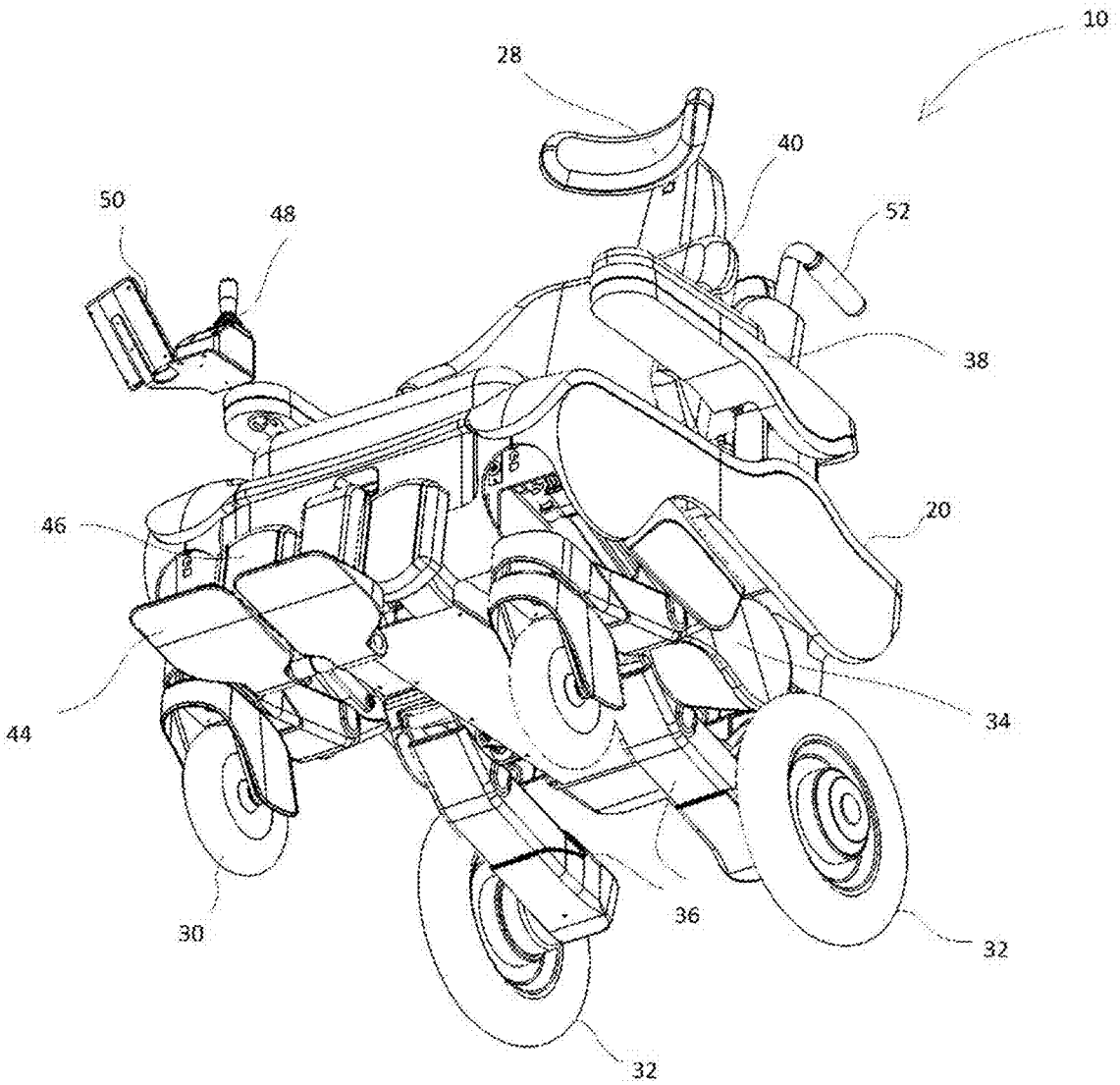
FIG. 2 is a perspective view from below of the assistive device of FIG. 1.
Figure 3:
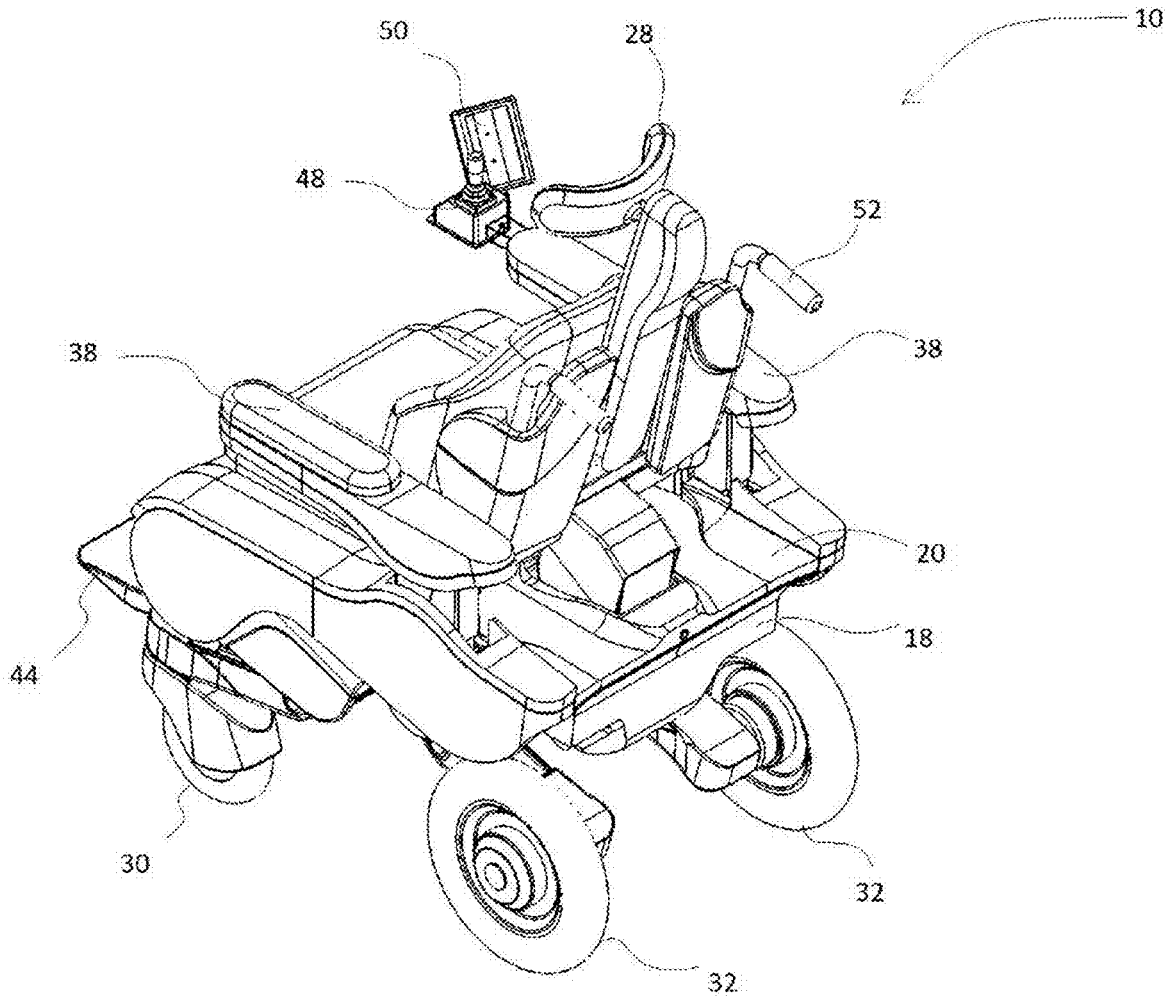
FIG. 3 is another perspective view of the wheelchair of FIG. 1.
Figure 4:
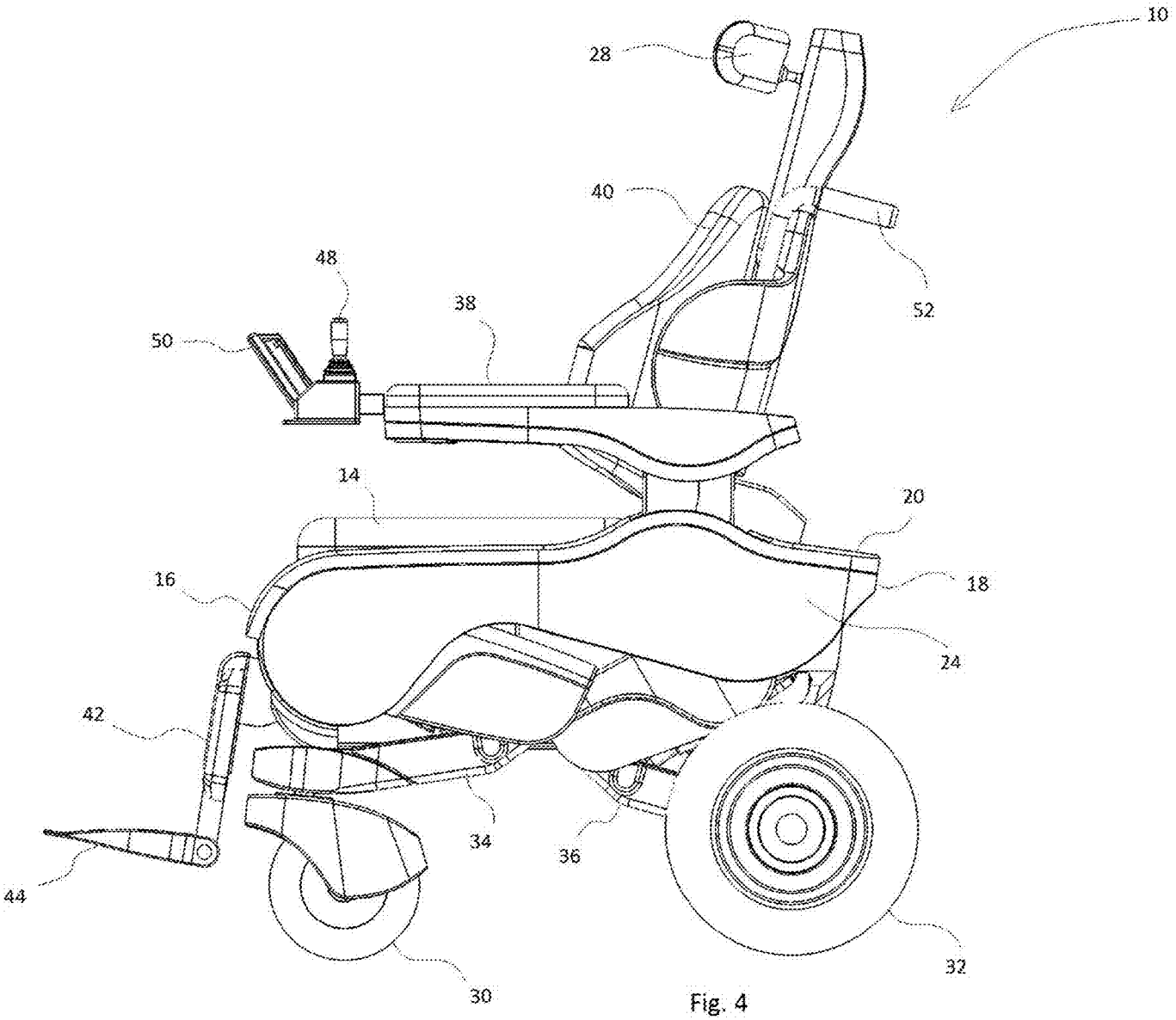
FIG. 4 is a side view of the assistive device of FIG. 1.
Figure 5:
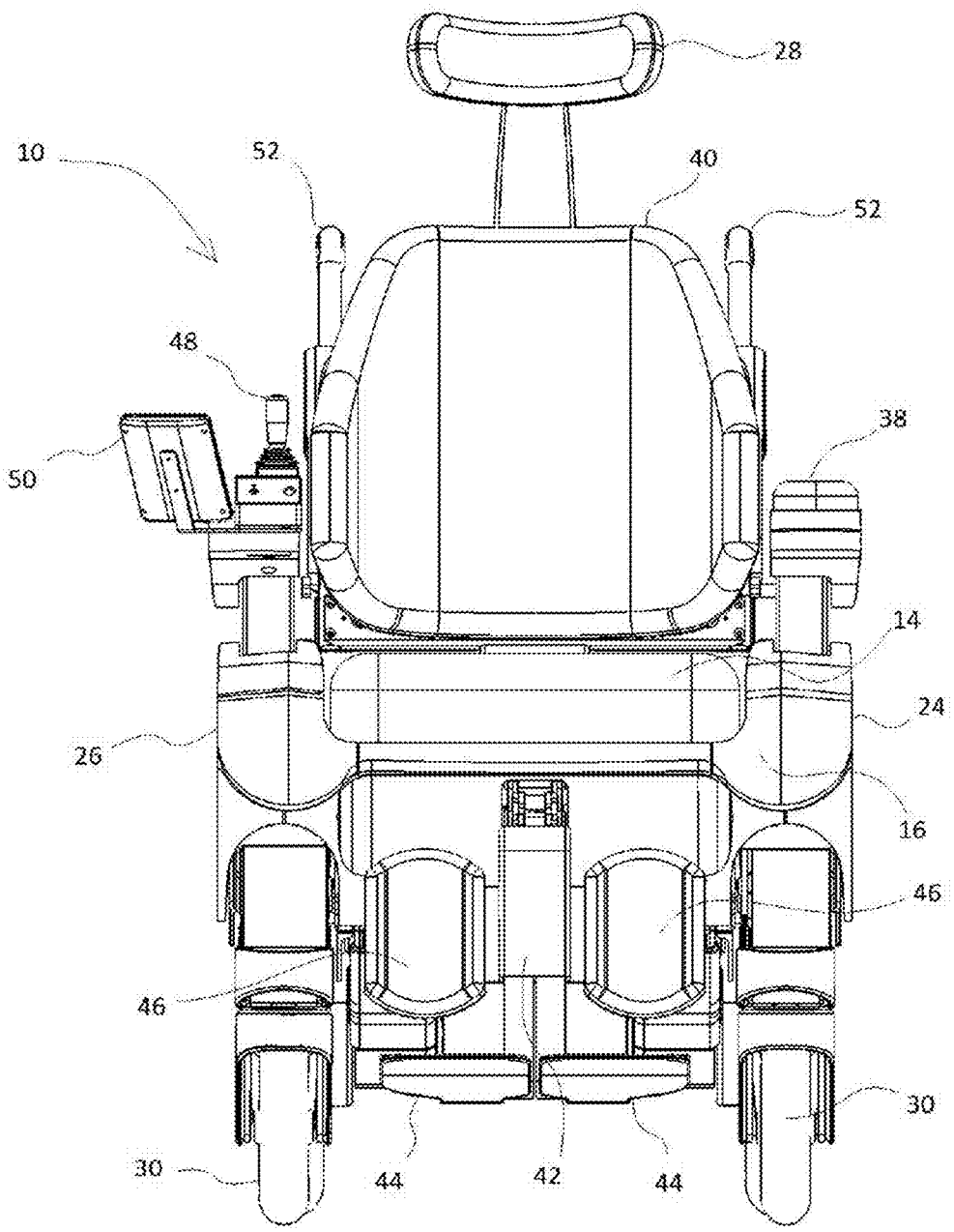
FIG. 5 is a front view of the assistive device of FIG. 1.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In the present disclosure, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this disclosure, language of "at least one of X, Y, and Z" and "one or more of X, Y and Z" can be construed as X only, Y only, Z only, or any combination of two or more items X, Y, and Z (e.g., XYZ, XY, YZ, ZZ, and the like). Similar logic can be applied for two or more items in any occurrence of "at least one . . . " and "one or more . . . " language.

The present disclosure generally relates to an assistive device for mobility impaired and elderly people that obviates the need to purchase several different assistive devices.

Figure 6:
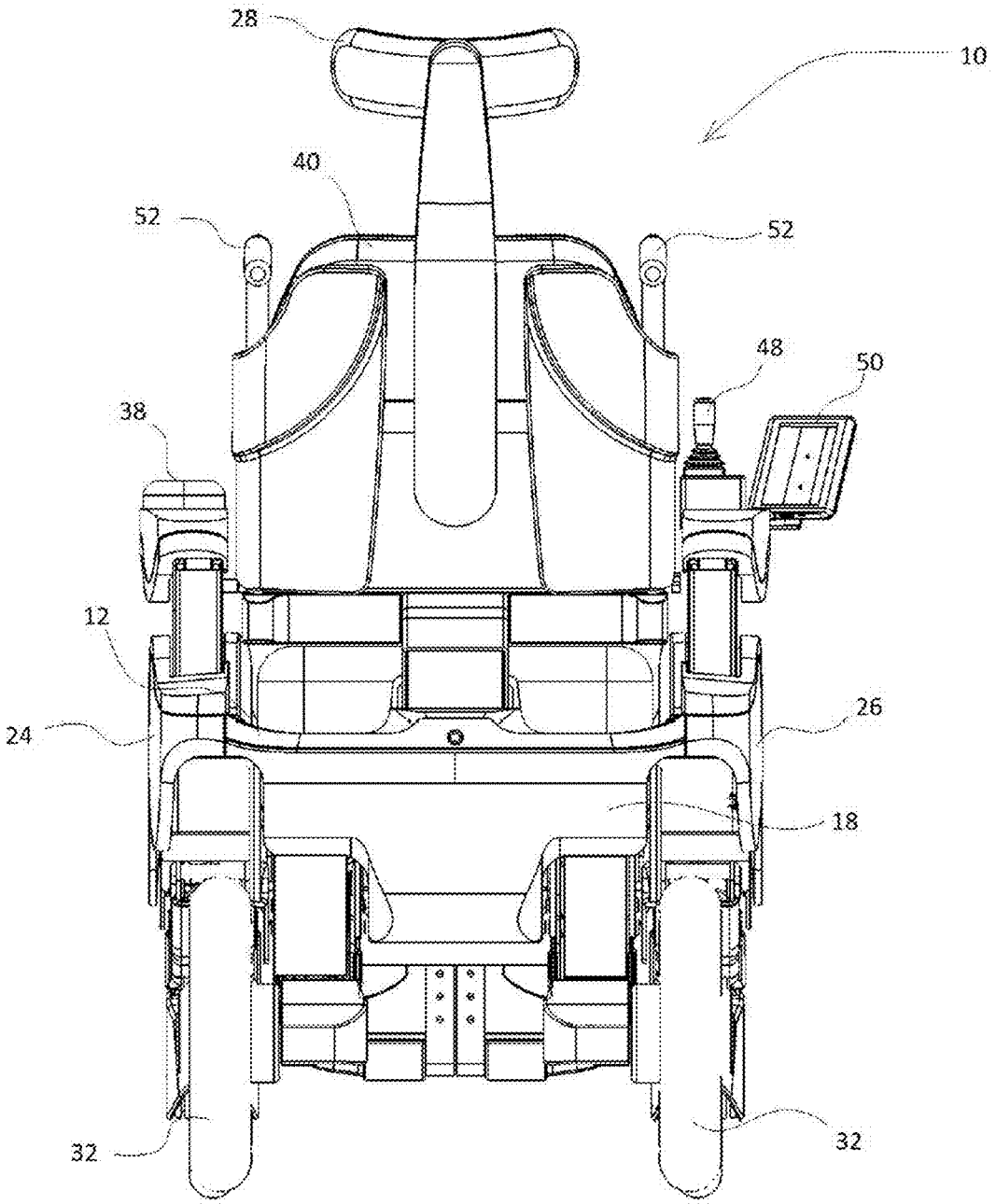
FIG. 6 is a rear view of the assistive device of FIG. 1.

FIG. 1 to FIG. 23 show an example embodiment of a configurable assistive device in accordance with the present disclosure. The configurable assistive device 10 (hereinafter referred to as assistive device 10) includes a platform 12 (see FIG. 6, FIG. 12), at least three wheels, and at least three independently controllable leg mechanisms. Each respective leg mechanism is coupled to the platform 12 and a respective one of the at least three wheels. Each respective leg mechanism is configured to move a portion of the platform 12 relative to the respective wheel to configure the assistive device 10 into one of a plurality of configurations as described in further detail below.

The platform 12 includes a front 16, a back 18, a top 20, a bottom 22, a left side 24 and a right side 26 opposing the left side 24. A seat cushion 14 is mounted on the top 20 of platform 12. In the example embodiment shown in FIG. 1 to FIG. 23, the assistive device 10 comprises four wheels including two front wheels 30 (visible in FIG. 1) and two rear wheels 32 (visible in FIG. 2, FIG. 3, and FIG. 6), and four independent leg mechanisms (two front leg mechanisms 34 visible in FIG. 1 and FIG. 5 and two rear leg mechanisms 36 visible in FIG. 2). Each of the two rear leg mechanisms 36 have a top end 54 coupled to the bottom 22 of the platform 12 proximate the back 18 of the platform 12 and a bottom end 56 coupled to one of the two rear wheels 32. Each of the two front leg mechanisms 34 also have a top end 58 coupled to the bottom 22 of the platform 12 proximate the front 16 of the platform 12 and a bottom end 60 coupled to one of the two front wheels 30. Each of the four independent leg mechanisms (e.g. the two front leg mechanisms 34 and the two rear leg mechanisms 36) are configured to open (e.g. extend vertically along the Z-axis in FIG. 1) and close (e.g. retract vertically along the Z-axis in FIG. 1), and pivot about a horizontal axis (e.g. the Y-axis shown in FIG. 1) to move the assistive device 10 into one of a plurality of different configurations as described in further detail below. In other words, the four independent leg mechanisms together define an elevation and inclination of the platform 12 by controlling distances between the attachment point of each respective leg mechanism and the respective wheel coupled the to respective leg mechanism.

In the example embodiment shown in FIG. 1 to FIG. 23, each front wheel 30 is a caster wheel and each rear wheel 32 is a drive to facilitate movement of the assistive device 10 over surfaces. Each rear leg mechanism 36 includes a drive mechanism for driving a respective rear wheel 32 of the two rear wheels. In alternative embodiments, each front wheel 30 is an omni-directional wheel and each rear wheel 32 is a drive wheel, and each rear leg mechanism 36 includes a drive mechanism for driving the respective rear wheel 32. In some other embodiments, each front wheel 30 is a drive wheel, each respective front leg mechanism 34 includes a drive mechanism for driving a respective front wheel 30, and rear wheel 32 is a caster wheel. In other alternative embodiments, each front wheel 30 is a caster wheel, each rear wheel 32 is a drive wheel, and each respective rear leg mechanism 36 includes a drive mechanism for driving a respective rear wheel 32. In still other embodiments, each front wheel 30 and each rear wheel 32 is a drive wheel, each respective front leg mechanism 34 includes a drive mechanism for driving a respective front wheel 30, and each respective rear leg mechanism 36 includes a drive mechanism for driving a respective rear wheel 32.

The assistive device 10 also includes a pair of collapsible armrests 38, a backrest 40, and a leg rest assembly 42. The backrest 40 extends substantially vertically from the top 20 of the platform 12 and is pivotally attached to the top 20 of the platform 12 for supporting a user when the user is seated on the seat cushion 14 when the assistive device 10 is in some of the plurality of configurations, such as, for example, when the assistive device 10 is in the normal/cruising configuration (FIG. 11), the ground level configuration (FIG. 13), the anterior tilt configuration (FIG. 18), the posterior tilt configurations (FIG. 19) as described in further detail below. The backrest 40 can pivot between a completely closed/collapsed position where a front face 43 of the backrest 40 faces and rests or lies on the seat cushion 14 (see FIG. 14 and FIG. 15) and a fully flat position where the backrest 40 extends substantially horizontally from the back 18 of the platform 12 (see FIG. 17). In some embodiments, the backrest 40 pivots/reclines between a vertical position in which the backrest 40 extends substantially vertically from the top 20 of the platform 12 (e.g. perpendicular to the top 20 of the platform 12) and a reclined position in which the backrest 40 is angled relative to the Z-axis. In some embodiments, the assistive device 10 includes an (see FIG. 12) that is coupled to the backrest 40. The anti-shredding mechanism extends gradually during reclining of the backrest 40, thereby allowing for a virtual pivot/rotation point of a back of a user (e.g. a person sitting on the seat cushion 14) to be positioned at the user's hips.

The assistive device 10 also includes a headrest 28 coupled to the backrest 40 for supporting a head of a user of the assistive device 10 when the user is seated on the seat cushion 14. In some embodiments, the headrest 28 is adjustable to position the headrest 28 at a height that corresponds to the height of a head of a user seated on the seat cushion 14. It will be appreciated that although the assistive device 10 shown in FIG. 1 to FIG. 23 includes the headrest 28, in alternative embodiments, the headrest 28 may be omitted from the assistive device 10.

One collapsible armrest of the pair of collapsible armrests 38 is mounted to the top 20 of the platform 12 between the seat cushion 14 and the left side 24 of the platform 12. The other collapsible armrest of the pair of collapsible armrests 38 is mounted to the platform 12 between the seat cushion 14 and the right side 26 of the platform 12. The pair of collapsible armrests 38 is configured to support the arms of a user and inhibit the user, such as an elderly person or a mobility impaired person, from falling out of the assistive device 10 when seated on the seat cushion 14. Each collapsible armrest 38 is collapsible from an extended position (see FIG. 1), where the collapsible armrests 38 inhibit a user sitting on the seat cushion 14 of the assistive device 10 from falling out of the assistive device 10, to a storage position (see FIG. 14) where a bottom of each collapsible armrest 38 rests against the top 20 of the platform 12. Each collapsible armrest 38 may be locked in either the extended position or the storage position by a locking mechanism (not shown).

In the example embodiment illustrated in FIG. 1 to FIG. 23, the leg rest assembly 42 is pivotally attached to the front 16 of the platform 12. The leg rest assembly 42 includes a foot rest 44 for supporting the feet of a user and calf pads 46 for supporting the calves of the user when the user is seated on the seat cushion 14 of the assistive device 10. The leg rest assembly 42 can be pivoted about the Y-axis between a first position (see FIG. 11) and a second position (see FIG. 17). In the first position, the leg rest assembly 42 extends substantially vertically from the bottom 22 of the platform 12 and the foot rest 44 extends substantially horizontally away from the leg rest assembly 42 in a direction away from the front 16 of the platform 12. In the second position, the leg rest assembly 42 extends substantially horizontally from the front 16 of the platform 12 (see FIG. 17) with the foot rest 44 extending substantially perpendicular to the calf pads 46 of the leg rest assembly 42. In some embodiments, the leg rest assembly 42 is extendable to adjust an overall length of the leg rest assembly 42. In some embodiments, the leg rest assembly 42 is detachable from the assistive device 10.

It will be appreciated that although the assistive device 10 of FIG. 1 to FIG. 22 includes a backrest 40, the collapsible armrests 38, and a leg rest assembly 42, in alternative embodiments, the assistive device 10 includes only one of the backrest 40, the collapsible armrests 38, and the leg rest assembly 42. In other alternative embodiments, the assistive device 10 includes any two of the backrest 40 and the collapsible armrests 38, and the leg rest assembly 42.

The assistive device 10 also includes a control panel 50 that is in communication with a control system (not shown) configured to independently control each of the four leg mechanisms to move the platform 12 of the assistive device 10 for positioning the platform 12 at an elevation and inclination (e.g. a desired or predetermined height and angle relative to a surface on which the wheels of the assistive device 10 rest on) by controlling a distance between an attachment point of each respective leg mechanism to the platform 12 and each respective wheel to configured the assistive device 10 into one of a plurality of different configurations. In the example embodiment shown in FIG. 1 to FIG. 23, the control system (not shown) independently controls each of the four leg mechanisms (e.g. the two front leg mechanisms 34 and the two rear leg mechanisms 36) to move one or more of the front 16, the back 18, the left side 24, and the right side 26 of the platform 12 for positioning the platform 12 at an elevation and/or for inclining the platform 12 to an inclination to configure the assistive device 10 into one of a plurality of different configurations by independently opening and closing each of the front leg mechanisms 34 and the rear leg mechanisms 36 to raise and lower one or more of the front 16, the back 18, the left side 24, and the right side 26 of the platform 12 relative to the front wheels 30 and the rear wheels 32. The opening and closing of the front leg mechanisms 34 and the rear leg mechanisms 36 are described in further detail below.

The control panel 50 enables a user (e.g. a person sitting in the assistive device 10) to configure the assistive device 10 into one of the plurality of configurations as needed. In each of the plurality of configurations, the platform 12 of the assistive device 10 is positioned at an elevation along the Z-axis and/or inclined or angled relative to the horizontal (i.e. the X-Y plane) to an inclination by opening and closing one or more of the front leg mechanisms 34 and the rear leg mechanisms 36 to increase and/or reduce a distance between an attachment point of a respective leg mechanism and the respective wheel to configure the assistive device 10 into one of the plurality of configuration shown in FIG. 11 to FIG. 23 described below. Each configuration of the assistive device 10 may be for a different purpose or function that is required to be performed by a person sitting on the seat cushion 14 of the assistive device.

The control panel 50 includes a touchscreen display that includes a graphical user interface (GUI) with a set of customizable selectable symbols (not shown). Each customizable selectable symbol is associated with one of the plurality of configurations for the assistive device 10. The association between each customizable selectable symbol and one of the plurality of configurations for the assistive device 10 is stored, for example, in the memory (not shown) of the assistive device 10. When a user presses on a symbol on the touchscreen display, selection of the symbol is detected by the control system (not shown). Responsive to detecting selection of a symbol, the control system (not shown) retrieves, from the memory, the one of the plurality of configurations stored in association with the selected symbol, controls one or more of the four leg mechanisms, the backrest 40, and the leg rest assembly 42, to configure the assistive device 10 into the configuration associated with the selected symbol. The customizable selectable symbol may be programmed based to a user of the assistive device 10 or may be programmed on assembly of the assistive device 10.

Although the GUI described above includes selectable symbols, in alternative embodiments, the GUI includes any suitable customizable selectable options, such as for example, menu option or selectable buttons in which each button is associated with one of the plurality of configurations for the assistive device 10 in the memory.

In some embodiments, the assistive device 10 stores, in the memory (not shown) data associated with each respective configuration of the plurality of configurations. The data associated with each respective configuration comprises one or more of data indicative of an elevation of the platform 12, data indicative of an inclination for the platform 12, data indicative of a position of the leg rest assembly 42, and data indicative of a position of the backrest 40. In this embodiment, the control system (not shown) includes one or more processors storing machine readable instructions, which when executed, causes the control system (not shown) to retrieve the data associated with one of the plurality of configurations in response to detecting selection of the selectable symbol associated with the one of the plurality of configurations, and configure the assistive device 10 based on the data retrieved from the memory (not shown).

In some embodiments, the control panel 50 may also include selectable symbols, options, or settings for one or more of changing a height of the platform 12 of the assistive device 10 (e.g. the elevation), changing a position of the leg rest assembly 42, changing a position of the backrest 40, and for changing an angle (e.g. an inclination) of the platform 12.

The assistive device 10 also includes a joystick 48 mounted to the one of the collapsible armrests 38 and in communication with the control system (not shown) for controlling the drive mechanism (not shown) of the rear wheels 32. The joystick 48 enables a user to control a speed and direction of movement of the assistive device 10.

In some embodiments, the control system (not shown) also controls the backrest 40 to move the backrest 40 between the closed/collapsed position and the fully flat position. In some other embodiments, the control system (not shown) also controls the leg rest assembly 42 to move the leg rest assembly 42 between the first and second positions.

Referring again to FIG. 1 to FIG. 6, the assistive device 10 also includes a pair of handles 52 coupled to the backrest 40 for enabling a person to manually push the assistive device 10 to move the assistive device 10 over a surface.

Figure 7:
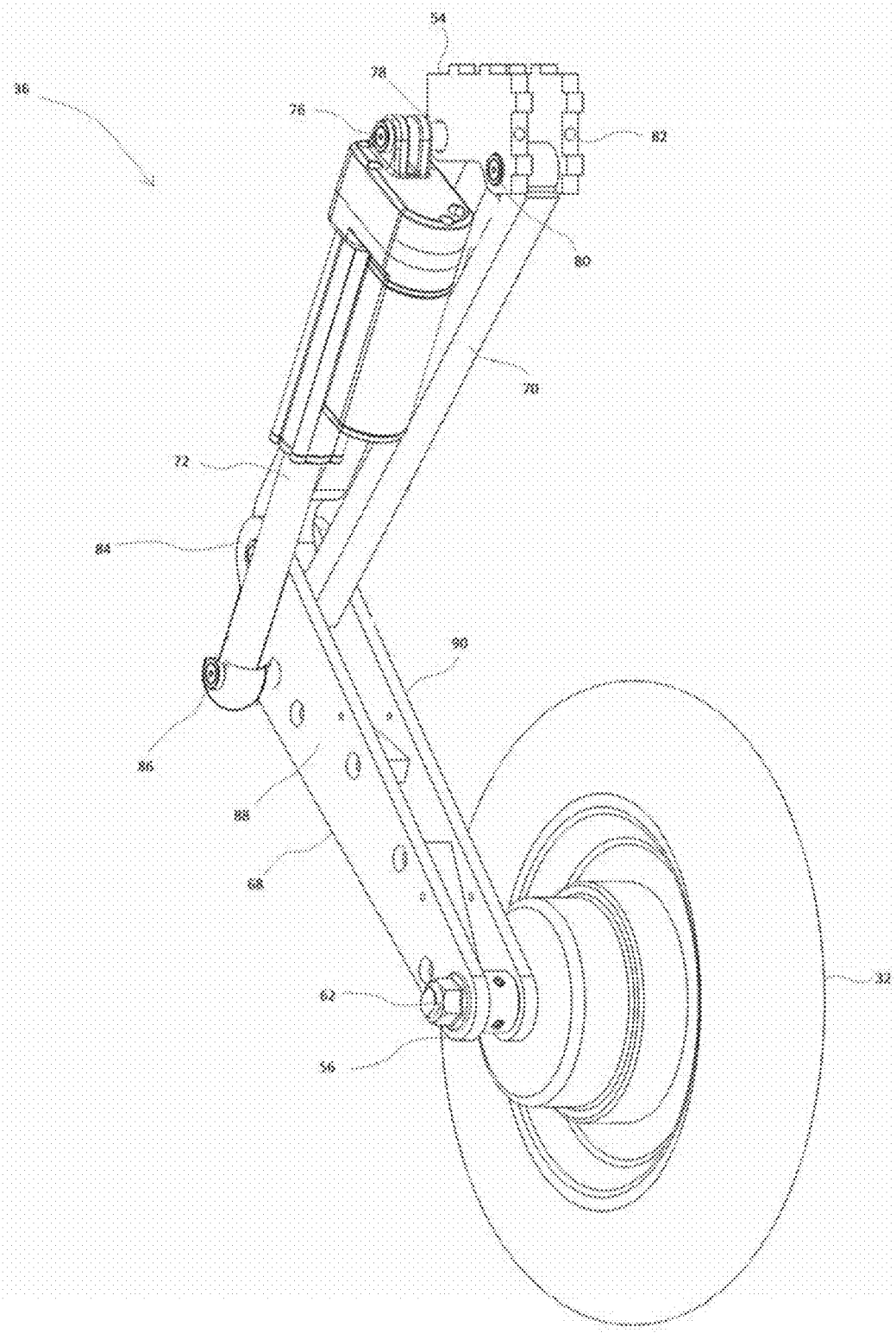
FIG. 7 is a front perspective view of a front leg mechanism of the assistive device of FIG. 1.
Figure 8:
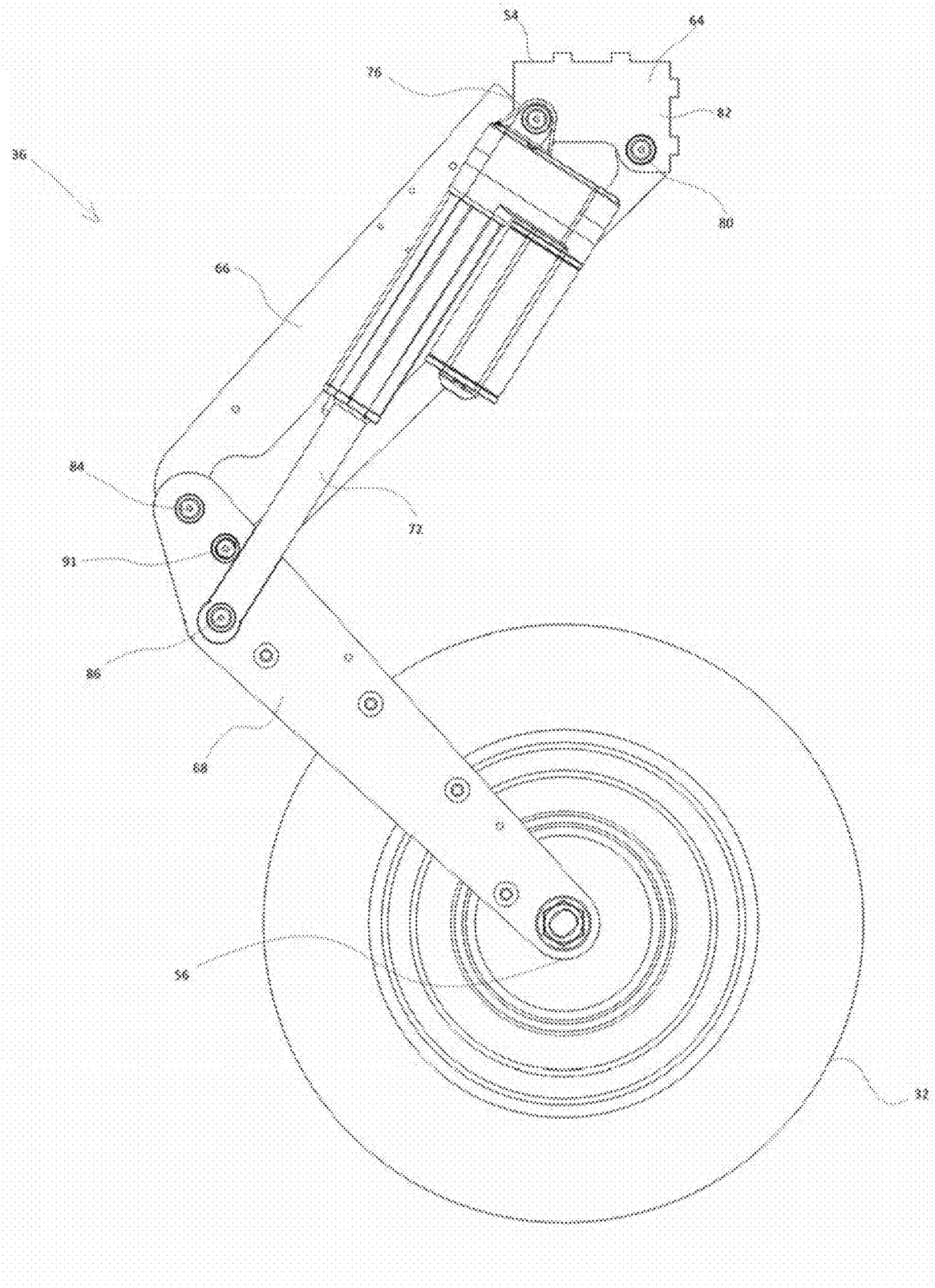
FIG. 8 is a side view of the front leg mechanism of FIG. 7.

Referring now to FIG. 7 and FIG. 8, an example embodiment of one of the two rear leg mechanisms 36 is shown. It will be appreciated that the other of the two rear leg mechanisms 36 is similar to the one rear leg mechanism 36 shown and hence not described in detail. As mentioned above, the top end 54 of the rear leg mechanism 36 is coupled to the bottom 22 of the platform 12 proximate the front 16 of the platform 12. The bottom end 56 of the rear leg mechanism 36 is coupled to an axel 62 of the rear wheel 32. In the embodiment shown in FIG. 7 and FIG. 8, the rear leg mechanism 36 includes a top bracket 64, a top link 66, a bottom link 68, a middle link 70, and a linear motor 72. The top bracket 64 is mounted to the bottom 22 of the platform 12. The top bracket 64 is pivotally connected to a top end of the top link 66 and a top end of the linear motor 72 at a pivot point 76 located at a front end 78 of the top bracket 64. The top bracket 64 is also pivotally connected to a top end of the middle link 70 at pivot point 80 located at a back end 82 of the top bracket 64.

A bottom end of the top link 66 is pivotally connected to a top end of the bottom link 68 at pivot point 84 and a bottom end of the linear motor 72 is pivotally connected to the top end of the bottom link 68 at pivot point 86. A bottom end of the middle link 70 is disposed between two arms 88, 90 of the bottom link 68 and pivotally connected to each arm 88, 90 at pivot point 91.

The operation of the rear leg mechanism 36 will now be described. To raise the platform 12 relative to the rear wheel 32 (e.g. change an elevation of the platform 12), the rear leg mechanism 36 opens to increase a vertical distance between the top bracket 64 (an attachment point of the rear leg mechanism 36 to the platform 12) and the rear wheel 32. To open the rear leg mechanism 36, the linear motor 72 pushes on the bottom link 68, increasing an angle between the top link 66 and the bottom link 68, which increases the vertical distance between the platform 12 and the rear wheel 32.

Figure 15:
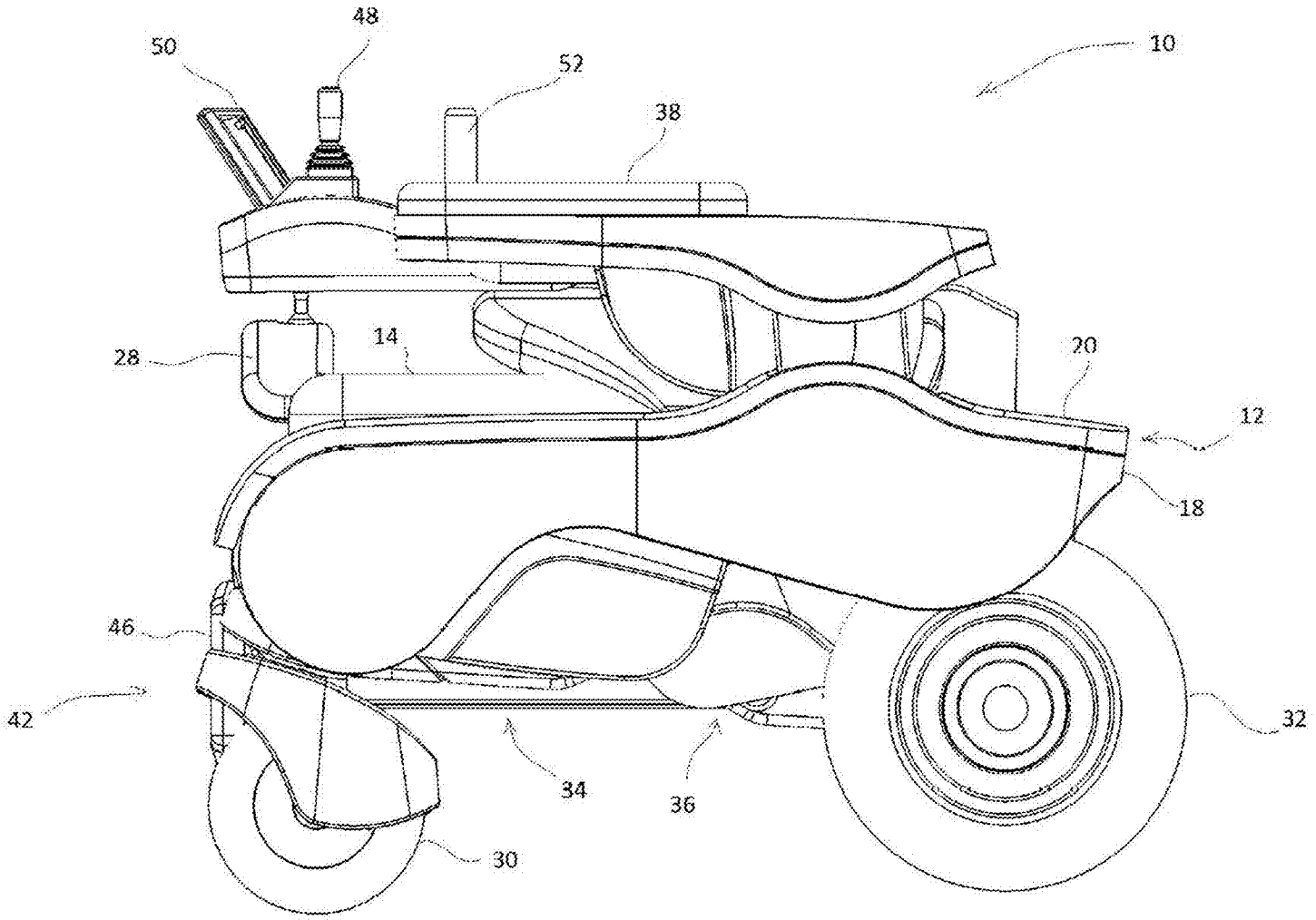
FIG. 15 is a side view of the assistive device of FIG. 1 in the storage configuration.
Figure 17:
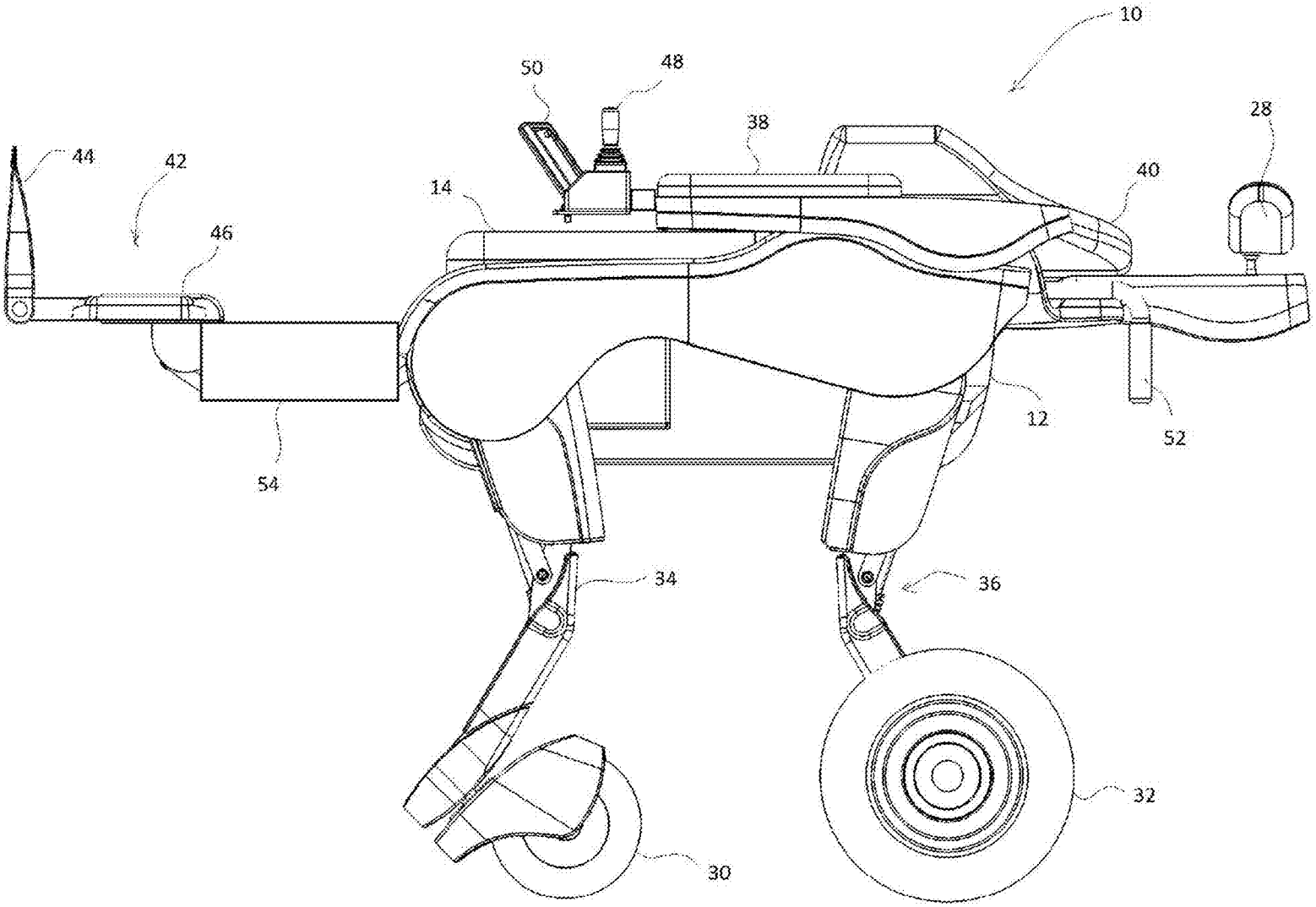
FIG. 17 is a side view of the assistive device of FIG. 1 in a fully-flat configuration.

To lower the platform 12 relative to the rear wheel 32, the rear leg mechanism 36 closes to decrease the vertical distance between the top bracket 64 (the attachment point of the rear leg mechanism 36 to the platform 12) and the rear wheel 32. To close the rear leg mechanism 36, the linear motor 72 pulls on the bottom link 68, decreasing an angle between the top link 66 and the bottom link 68, which decreases the vertical distance between the platform 12 and the rear wheel 32. It will be appreciated that the rear leg mechanism 36 is moveable between an open position in which the rear leg mechanism 36 is fully extended (e.g. the angle between the top link 66 and the bottom link 68 is approximately 180 degrees as shown in FIG. 17) and a closed position in which the rear leg mechanism 36 is collapsed such that the rear wheel 32 is adjacent the platform 12 (e.g. the angle between the top link 66 and the bottom link 68 is approximately 0 degrees, as shown in FIG. 15).

Figure 9:
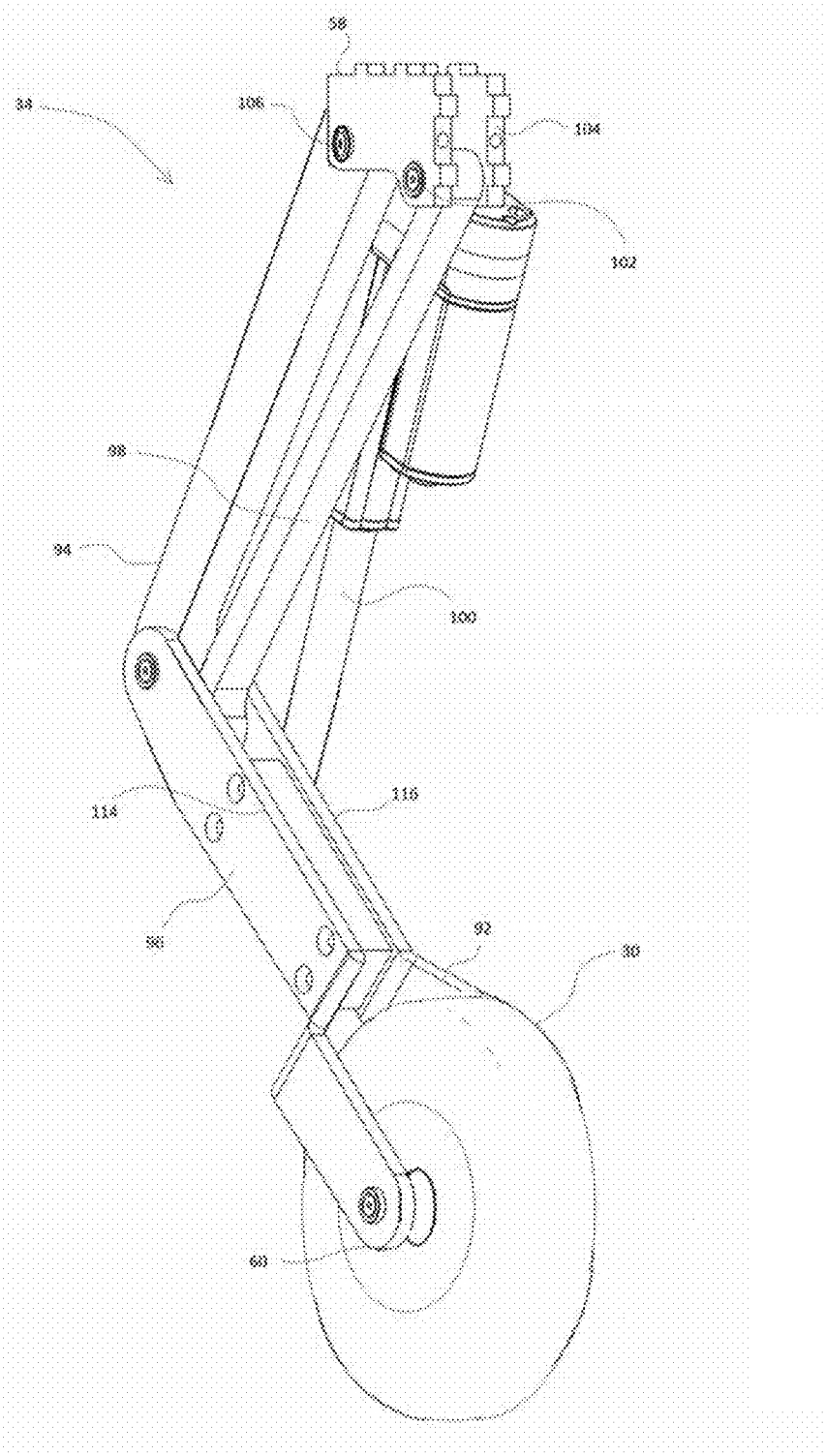
FIG. 9 is a front perspective view of a rear leg mechanism of the assistive device of FIG. 1.
Figure 10:
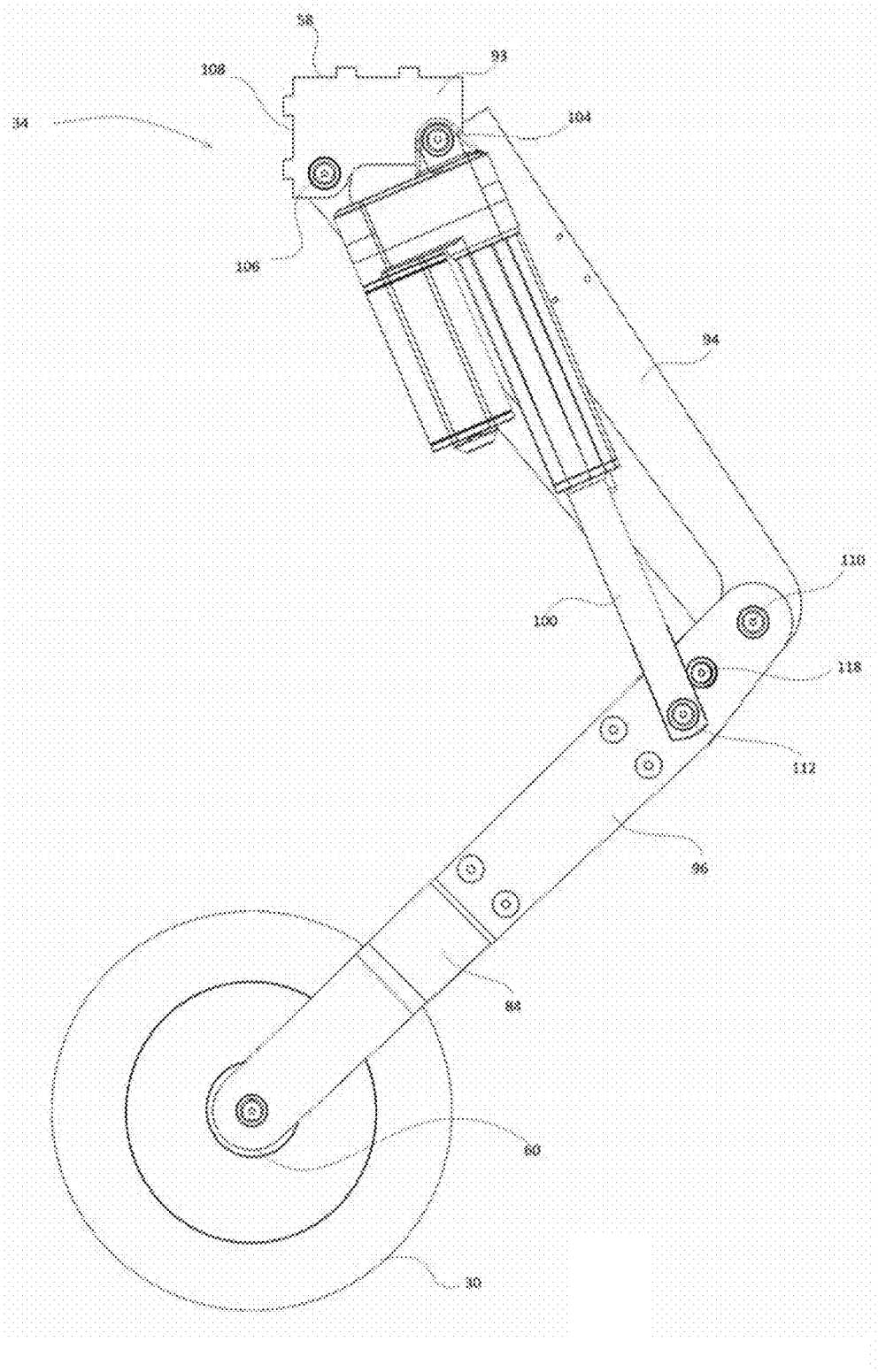
FIG. 10 is a side view of the front leg mechanism of FIG. 9.

Referring now to FIG. 9 and FIG. 10, an example embodiment of one of the two front leg mechanisms 34 is shown. It will be appreciated that the other of the two front leg mechanisms 34 is similar to the one front leg mechanism 34 shown and hence not described in detail. As mentioned above, the top end 58 of the front leg mechanism 34 is coupled to the bottom 22 of the platform 12 proximate the front 16 of the platform 12. The bottom end 60 of the front leg mechanism 34 is coupled to the axels of the front wheel 30 via a castor fork 92 of the front wheel 30. In the embodiment shown in FIG. 9 and FIG. 10, the front leg mechanism 34 includes a top bracket 93 (see FIG. 10), a top link 94, a bottom link 96, a middle link 98, and a linear motor 100. The top bracket 93 is mounted to the bottom 22 of the platform 12. The top bracket 93 is pivotally connected to a top end of the top link 94 and a top end of the linear motor 100 at pivot point 102 located at a front end 104 of the top bracket 93. The top bracket 93 is also pivotally connected to a top end of the middle link 98 at a pivot point 106 located at a back end 108 of the top bracket 93.

A bottom end of the top link 94 is pivotally connected to a top end of the bottom link 96 at pivot point 110 and a bottom end of the linear motor 100 is pivotally connected to the top end of the bottom link 96 at pivot point 112. A bottom end of the middle link 98 is disposed between two arms 114, 116 of the bottom link 96 and pivotally connected to each arm 114, 116 at pivot point 118.

The operation of the front leg mechanism 34 will now be described. To raise the platform 12 relative to a front wheel 30. To raise the platform 12 relative to the front wheel 30 (e.g. change an elevation of the platform 12), the front leg mechanism 34 opens to increase a vertical distance between the top bracket 93 (an attachment point of the front leg mechanism 34 to the platform 12) and the front wheel 30. To open the front leg mechanism 34, the linear motor 100 pushes on the bottom link 96, increasing an angle between the top link 94 and the bottom link 96, which increases the vertical distance between the platform 12 and the front wheel 30.

To lower the platform 12 relative to the front wheel 30, the front leg mechanism 34 closes to decrease the vertical distance between the top bracket 93 (the attachment point of the front leg mechanism 34 to the platform 12) and the front wheel 30. To close the front leg mechanism 34, the linear motor 100 pulls on the bottom link 96, decreasing an angle between the top link 94 and the bottom link 96, which decreases the vertical distance between the platform 12 and the front wheel 30. It will be appreciated that the front leg mechanism 34 is moveable between an open position in which the rear leg mechanism 36 is fully extended (e.g. the angle between the top link 94 and the bottom link 96 is approximately 180 degrees as shown in FIG. 17) and a closed position in which the front leg mechanism 34 is collapsed such that the front wheel 30 is adjacent the platform 12 (e.g. the angle between the top link 94 and the bottom link 96 is approximately 0 degrees, as shown in FIG. 15).

It will be appreciated that in although the structure of the front leg mechanism 34 and the rear leg mechanism 36 are different in the embodiment shown in FIG. 1 to FIG. 23, in alternative embodiments the structure of each of the at least three leg mechanisms of the assistive device 10 are identical. In these embodiments, each of the at least three wheels are also identical.

The terms front, back, top, bottom, right side, left side, vertical, and horizontal are utilized herein to provide reference to the orientation of the assistive device 10 is use, such as, for example, a mobility impaired or elderly person, sitting in the assistive device 10. The term elevation is utilized herein to refer to a vertical distance (e.g. a distance along the Z-axis shown in FIG. 1) between a surface (such as the ground) on which the wheel of the assistive device 10 rests on and the platform 12 along the Z-axis shown in FIG. 1. The term inclination is utilized herein to refer to an angle of the platform 12 of the assistive device 10 relative to the X-axis and Y-axis shown in FIG. 1. The terms X-axis, Y-axis, and Z-axis refer to the orientation of a three-axis Cartesian coordinate system with respect to a surface on which the wheels of the assistive device 10 rest on. The X-Y plane is horizontal (e.g. parallel to the surface on which the wheels of the assistive device 10 rest on) and the Z-axis is vertical (e.g. perpendicular to the surface on which the wheels of the assistive device 10 rest on).

Figure 11:
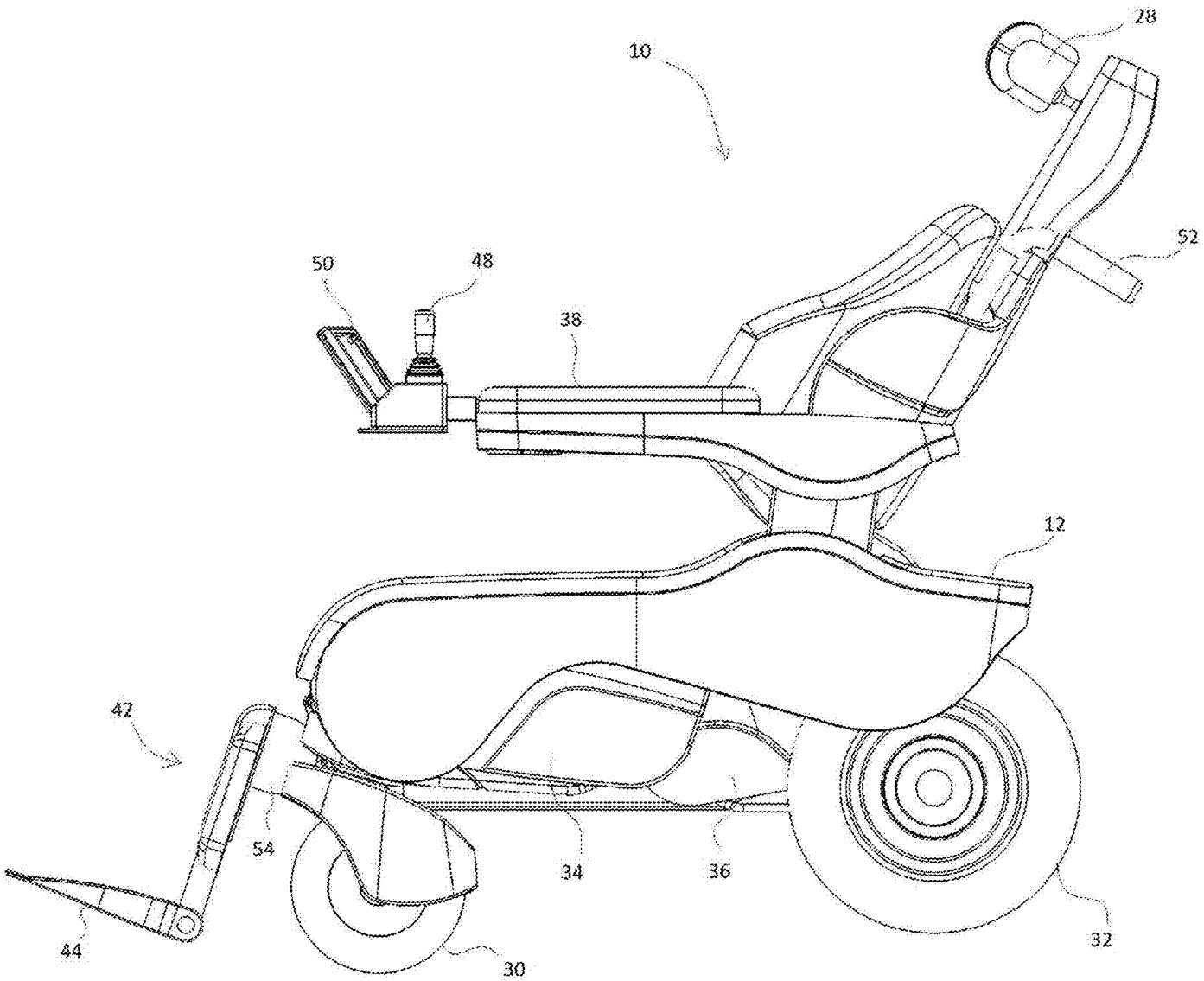
FIG. 11 is a side view of the assistive device of FIG. 1 in a normal/cruising configuration.
Figure 20:
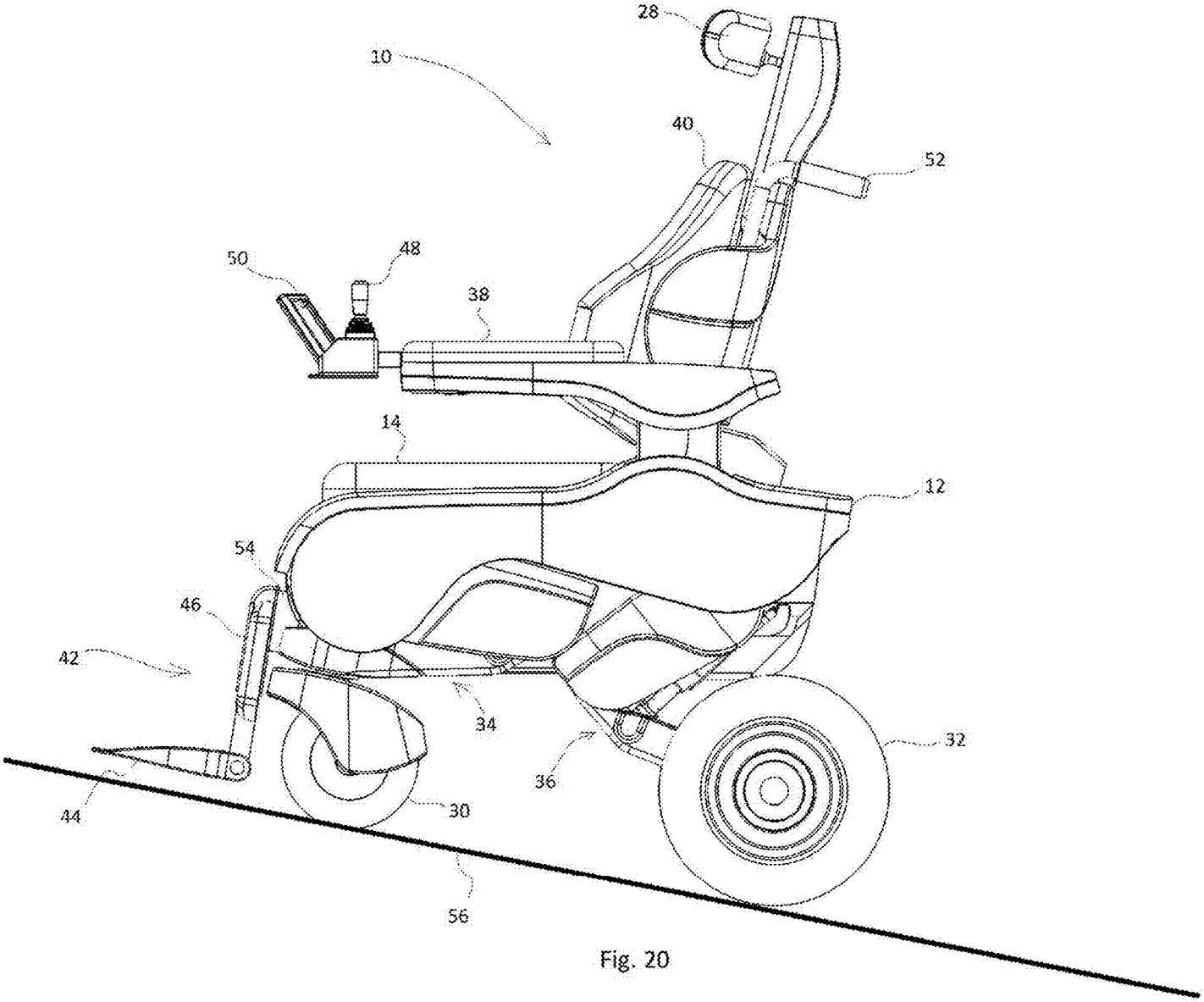
FIG. 20 is a side view of the assistive device of FIG. 1 in a self-leveling mode while ascending.
Figure 21:
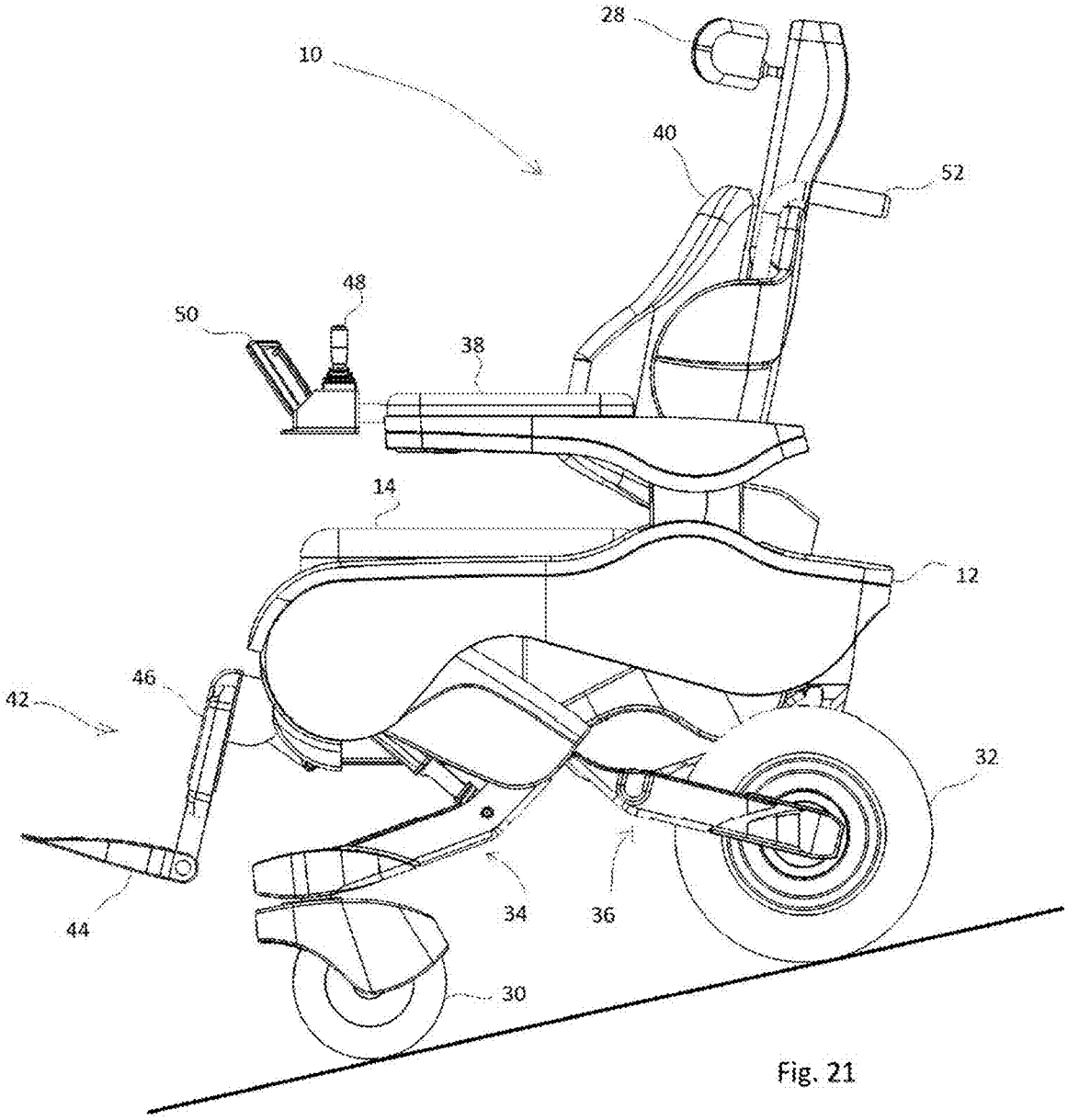
FIG. 21 is a side view of the assistive device of FIG. 1 in a self-leveling mode configuration while descending.

The plurality of configurations of the assistive device 10 will now be described with reference to FIG. 11 to FIG. 19, and FIG. 22 and FIG. 23. FIG. 20, and FIG. 21 show two modes of operation for the assistive device 10. FIG. 11 shows the assistive device 10 is shown in a normal/cruising configuration in which the assistive device 10 is used to transport a person, such as, for example, a mobility impaired or elderly person. In this configuration, the leg rest assembly 42 is tilted with respect to the Z-axis (FIG. 1) so that a person is seated comfortably in the assistive device 10.

Figure 12:
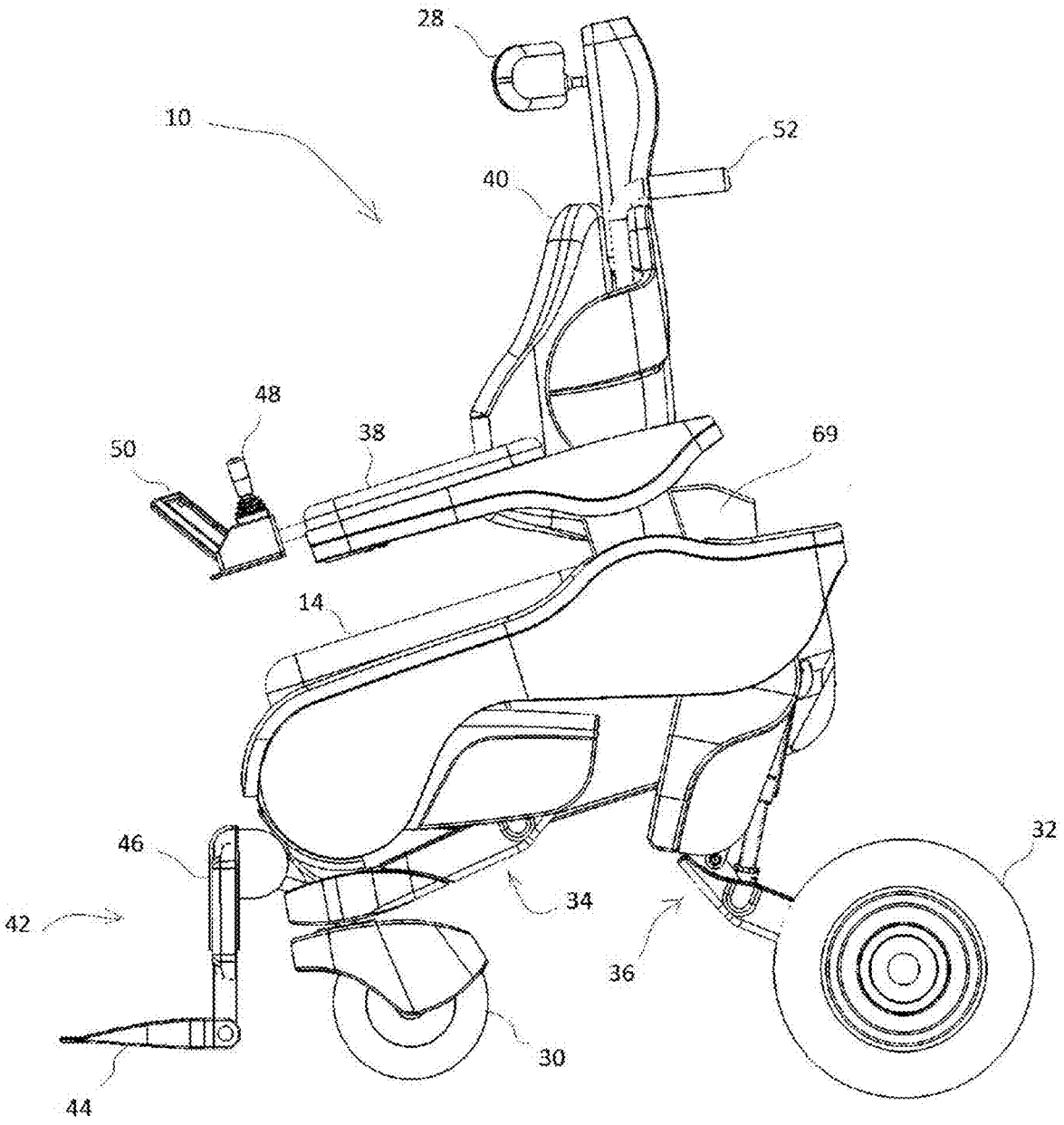
FIG. 12 is a side view of the assistive device of FIG. 1 in an anterior tilt configuration.

Referring to FIG. 12, the assistive device 10 is shown in an anterior tilt configuration. In this configuration, the assistive device 10 is tilted forward with respect to the Z-axis (FIG. 1) which facilitates the transfer of a user (e.g. a person sitting on the seat cushion 14 of the assistive device 10 to transfer to a bed, a chair, or another assistive device.

Figure 13:
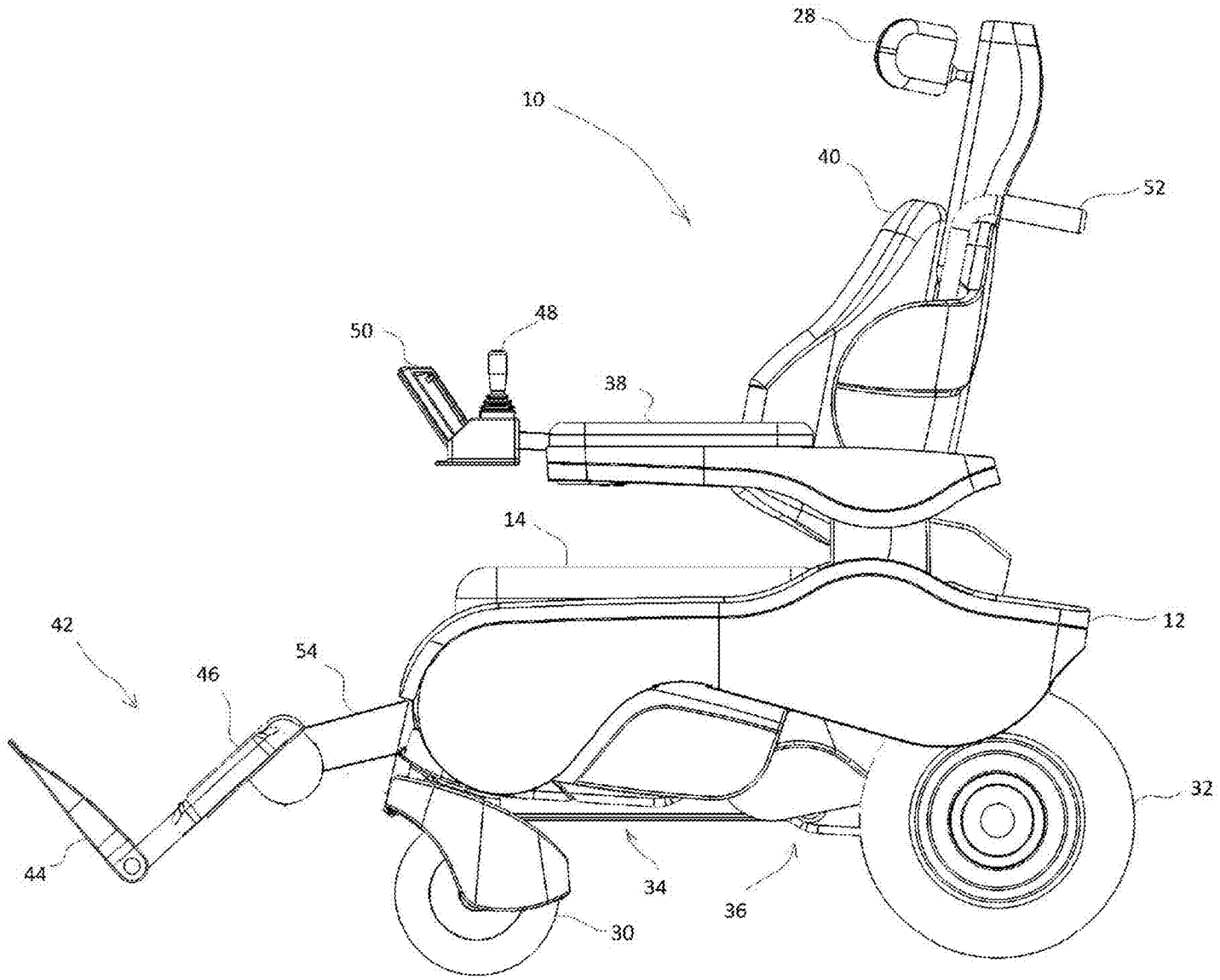
FIG. 13 is a side view of the assistive device of FIG. 1 in a ground level configuration.

Referring to FIG. 13, the assistive device 10 is shown in a ground level configuration so that when a mobility impaired or elderly person is seated on the seat cushion 14 of the assistive device 10, the mobility impaired or elderly person is near the ground. In ground level configuration, the assistive device 10 enables a person sitting on the seat cushion 14 of the assistive device 10 to grab objects that are on the floor, interact with children, pets, plants, and cruise safely on inclined and rough surfaces. When cruising on rough or inclined surface, the ground level configuration of the assistive device 10 moves a center of gravity a person using the assistive device 10 closer to the ground which reduces the swinging of the assistive device 10 and the risk of the assistive device 10 tipping during cruising. To configure the assistive device 10 in the ground level configuration, the control system (not shown) detects selection of the selectable button associated with the ground level configuration, and controls the front leg mechanics 34 and the rear leg mechanisms 36 to close the front legs mechanisms 34 and the rear legs mechanisms 36 to move the platform 12 towards to the front wheels 30 and rear wheels 32 to reduce an overall height of the assistive device 10 (e.g. a distance between the respective wheels and the platform 12) until each respective wheel is in a closed position and the platform 12 is proximate the ground.

Figure 14:
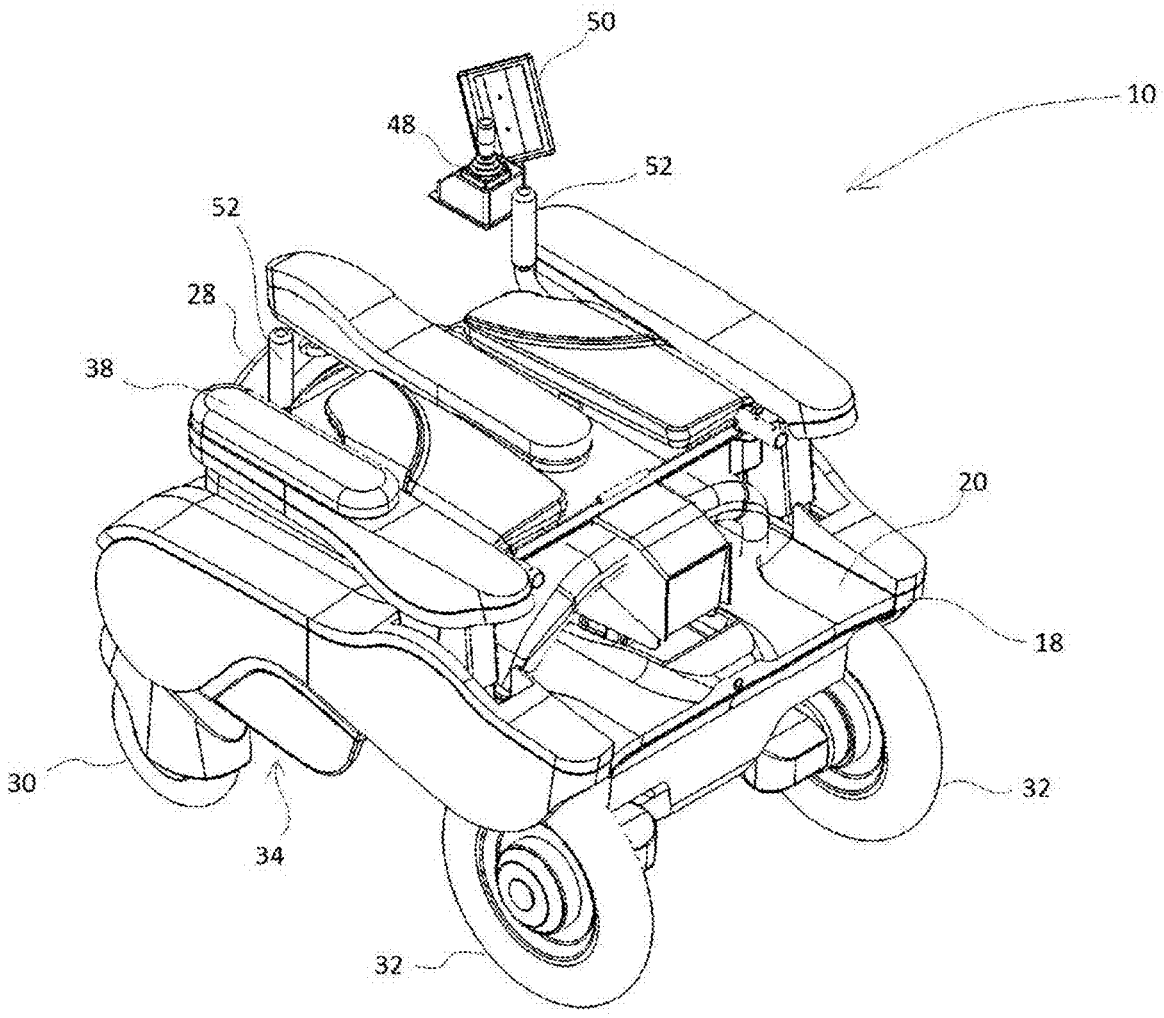
FIG. 14 is a perspective view of the assistive device of FIG. 1 in a storage configuration.

Referring to FIG. 14 and FIG. 15, the assistive device 10 is shown in a storage configuration which facilitates transportation and storage of the assistive device 10 in a vehicle. In the storage configuration, each collapsible armrest 38 is in the collapsed position, the backrest 40 is closed/collapsed position, and the leg rest assembly 42 is detached from the assistive device 10 to reduce the overall size of the assistive device 10 for storage or transportation.

Figure 16:
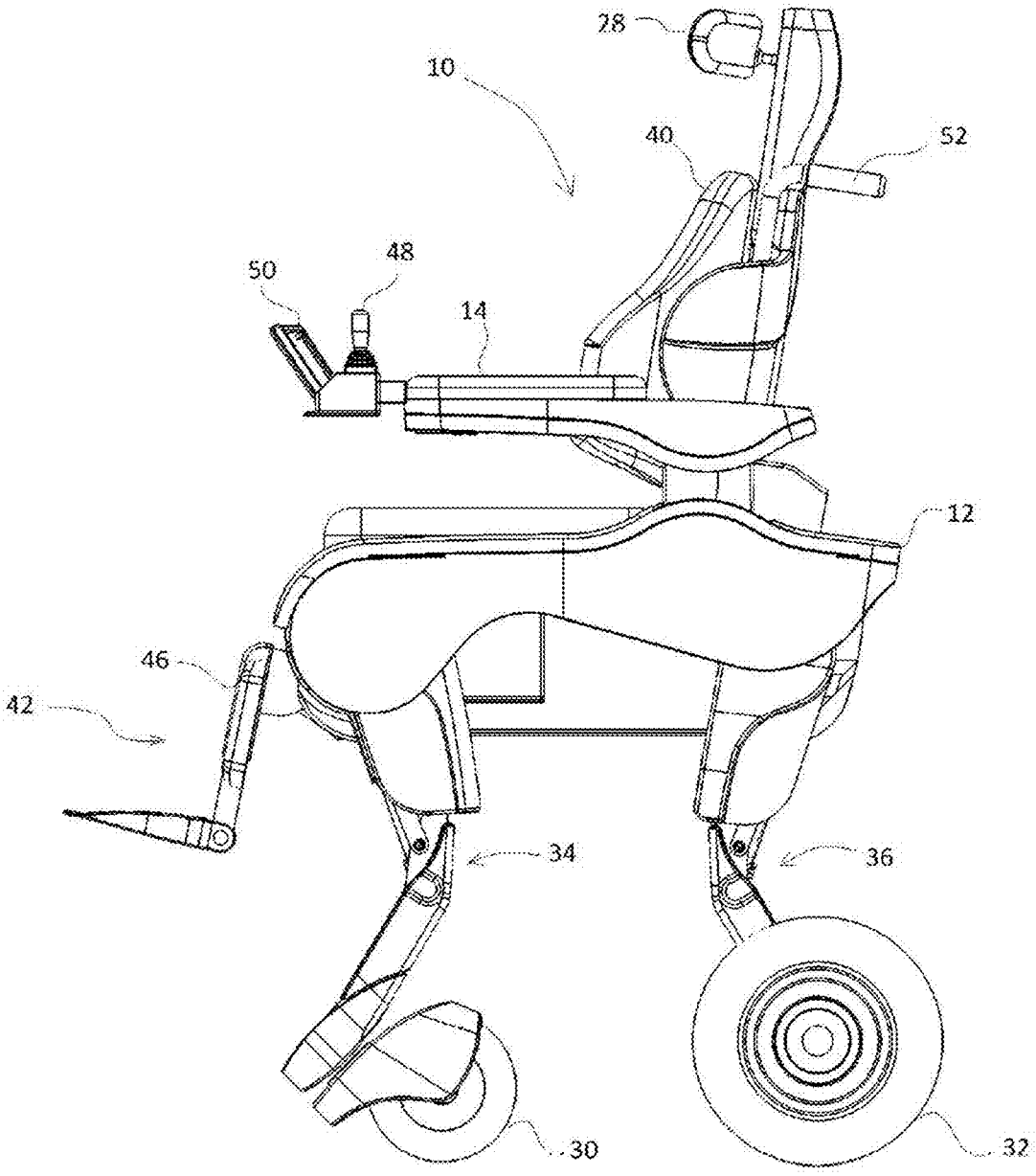
FIG. 16 is a side view of the assistive device of FIG. 1 in a raised configuration.

Referring to FIG. 16, the assistive device 10 is shown in a raised configuration. When the assistive device is in a raised configuration, a mobility impaired or elderly person is seated in the assistive device 10 is high relative to the ground to enable a user to access high kitchen cabinets, high table, or high shelves, such as for example, while grocery shopping. The configuration shown in FIG. 16 also allows for an "eye-to-eye" conversation with another person standing near the assistive device 10. To configure the assistive device 10 in the raised configuration, the control system (not shown) independently controls each of the four leg mechanisms (e.g. the front leg mechanisms 34 and the rear leg mechanisms 36) to open each of the four leg mechanisms (e.g. each of the front leg mechanisms 34 and the rear leg mechanisms 36 to move the platform 12 away from the front wheels 30 and rear wheels 32 to increase an overall height of the assistive device 10 (e.g. a distance between each of the four wheels and the platform 12) until each respective wheel is in an open position.

Referring to FIG. 17, the assistive device 10 is shown in a fully-flat configuration which enables a person to rest on the assistive device 10, and which facilitates transferring to and from the assistive device 10 to a bed. The fully-flat configuration also facilities the administration of personal hygiene and medical procedures by medical personnel and/or caregivers of mobility impaired or elderly people when the assistive device 10 is used by such people. In the fully-flat configuration, the backrest 40 is pivoted into its collapsed position and the leg rest assembly 42 is raised into its second position so that the backrest 40, the seat cushion 14, and the leg rest assembly 42 provide an extended horizontal surface for a person to lie on.

Figure 18:
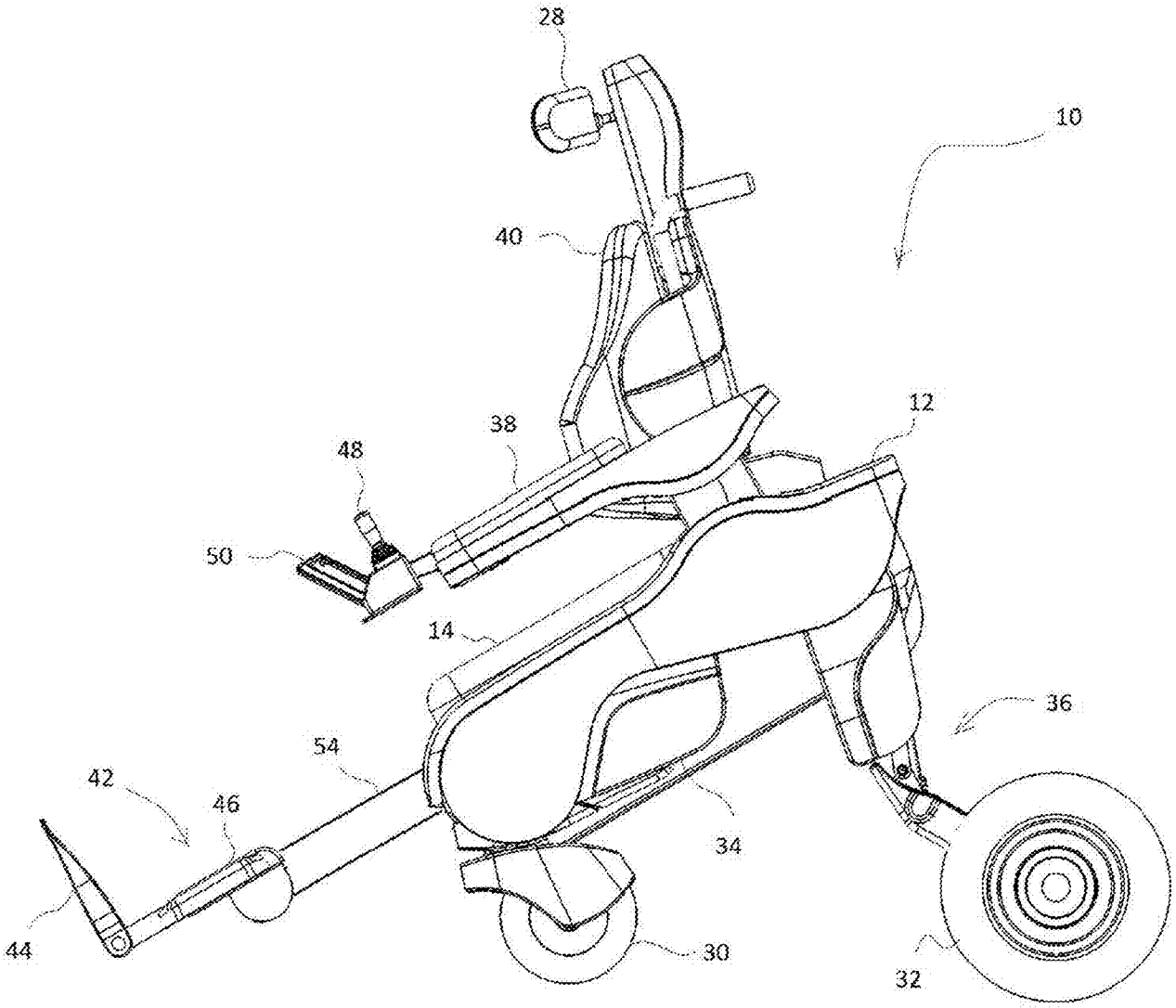
FIG. 18 is a side view of the assistive device of FIG. 1 in an anterior tilt configuration.
Figure 19:
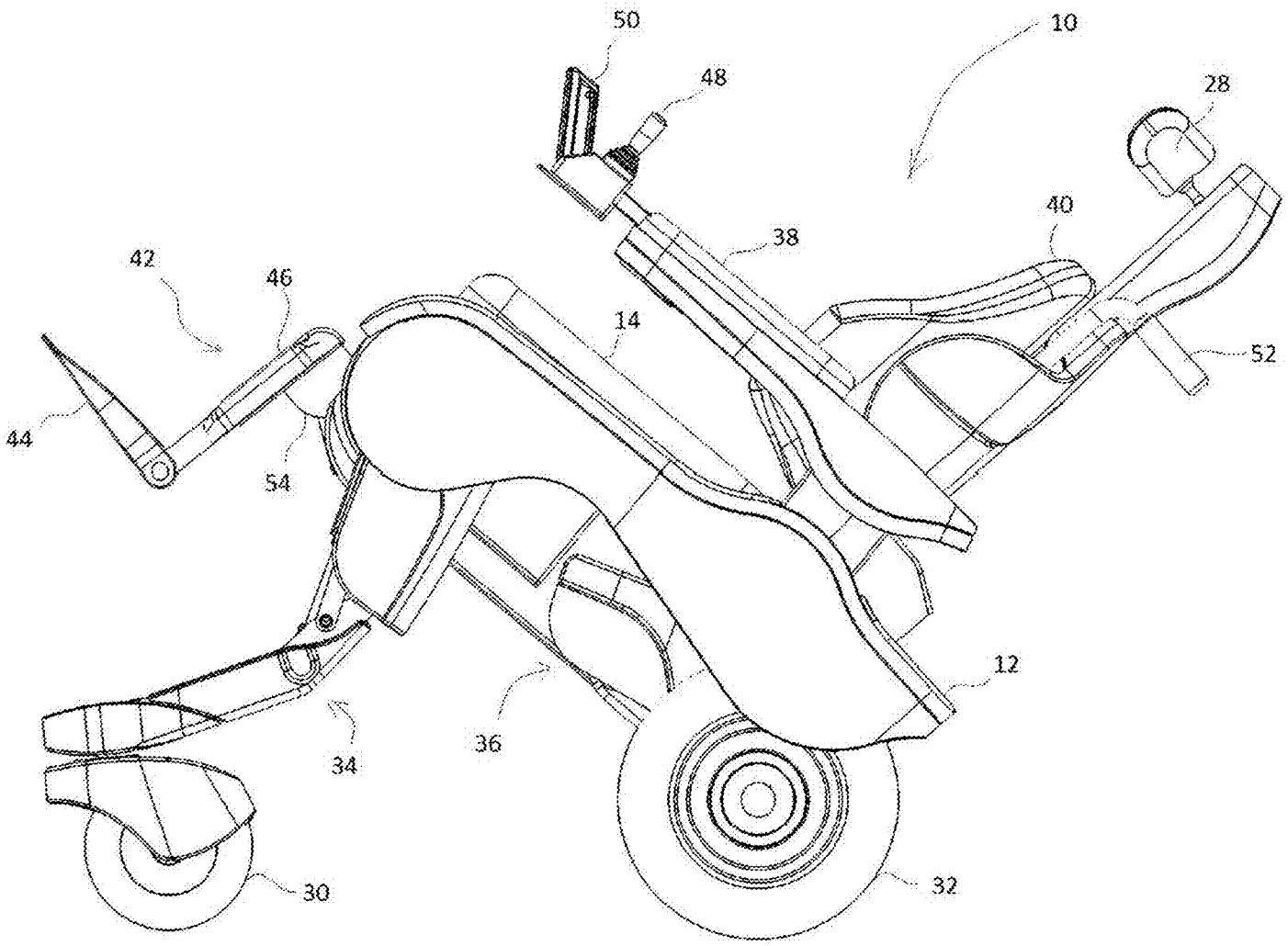
FIG. 19 is a side view of the assistive device of FIG. 1 in a posterior tilt configuration.

Referring to FIGS. 18 and 19, the assistive device 10 is shown in an anterior tilting configuration and a posterior tilting configuration, respectively. To configure the assistive device 10 into the anterior configuration (FIG. 18), the front leg mechanisms 34 moves the front 16 of the platform 12 towards to the front wheels 30 (e.g. reduce a vertical distance between the front wheels 30 and the platform 12) and the rear leg mechanisms 36 close (e.g. increase a vertical distance between the rear wheels 32 and the platform 12) to move the back 18 of the platform away from the rear wheels 32 to tilt the front of the assistive device 10 towards the ground. The front leg mechanisms 34 move the front 16 of the platform 12 towards to the front wheels 30 by closing the front leg mechanisms 34, and the rear leg mechanisms 36 move the back 18 of the platform away from the rear wheels 32 by opening the rear leg mechanisms 36 as described above. As the platform 12 moves (e.g. tilts), a person sitting on the seat cushion 14 stays in the same seated position as the assistive device 10 tilts forwards.

To configure the assistive device 10 into the posterior tilting configuration, the front leg mechanisms 34 moves the front 16 of the platform 12 away from the front wheels 30 (e.g. increase a vertical distance between the front wheels 30 and the platform 12) and the rear leg mechanism 36 moves the back 18 of the platform towards from the rear wheels 32 (e.g. reduce a vertical distance between the rear wheels 32 and the platform 12) to tilt the back of the assistive device 10 towards the ground. The front leg mechanisms 34 move the front 16 of the platform 12 away from the front wheels 30, and the rear leg mechanisms 36 move the back 18 of the platform toward the rear wheels 32 by closing the rear leg mechanisms 36 as described above. As the platform 12 moves (e.g. tilts), a person sitting on the seat cushion 14 stays in the same seated position as the assistive device 10 tilts backwards.

It will be appreciated that the anterior tilt configuration facilitates standing or transfer of a person using the assistive device 10 to another device. In the posterior tilt configuration, an angle of backrest 40 relative to the platform 12 reduces the likelihood of development of muscle fatigue, skin ruptures and pressure sores and helps in providing blood circulation to the limbs of a person using the assistive device 10 (e.g. a mobility impaired or elderly individual sitting on the seat cushion 14).

In an alternative embodiment, the control system (not shown) of the assistive device 10 is configured to control the front leg mechanisms 34 and the rear leg mechanisms 36 to open and close to automatically change the configuration of the assistive device 10 to between the anterior tilt configuration and the posterior tilt configuration at predetermined time intervals to change a user's pressure points and reduce the likelihood of the development of pressure sores.

Referring to FIGS. 20 and 21, the assistive device 10 is shown in self-leveling mode while ascending and descending an inclined surface. In the embodiment shown in FIGS. 20 and 21, the assistive device 10 includes a gyroscopic sensor (not shown) configured to detect a change in a position of the platform 12 of the assistive device 10 relative to the surface. The control system (not shown) communicates with to the gyroscopic sensor (not shown) and executes software (e.g. machine readable instructions) that controls the front leg mechanisms 34 to open the front leg mechanisms 34 and/or the rear leg mechanisms 36 to raise (elevate) the platform 12 relative to the front wheels 30 and/or rear wheels 32 (e.g. increase a vertical distance between the platform 12 and the front wheels 30 and/or rear wheels 32) and to close the front leg mechanisms 34 and/or rear leg mechanisms 36 to lower the platform 12 relative to the front wheels 30 and/or rear wheels 32 (e.g. decrease a vertical distance between the platform 12 and the front wheels and/or the rear wheels 32) based on the detected change in a position of the platform 12 relative to the surface to achieve pre-programed horizontal level range for the platform 12.

Figure 22:
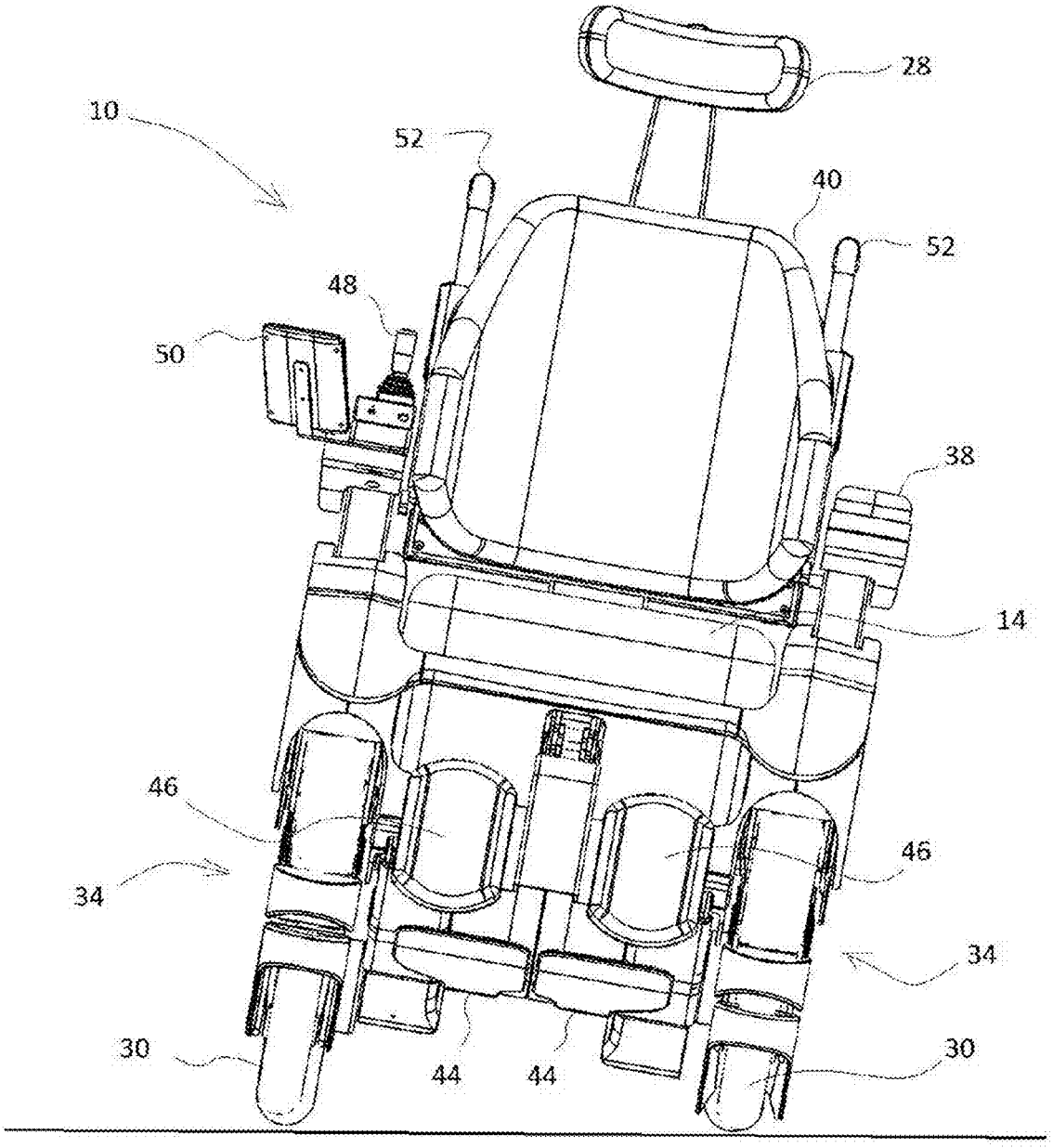
FIG. 22 is a side view of the assistive device of FIG. 1 in a right lateral tilt configuration.
Figure 23:
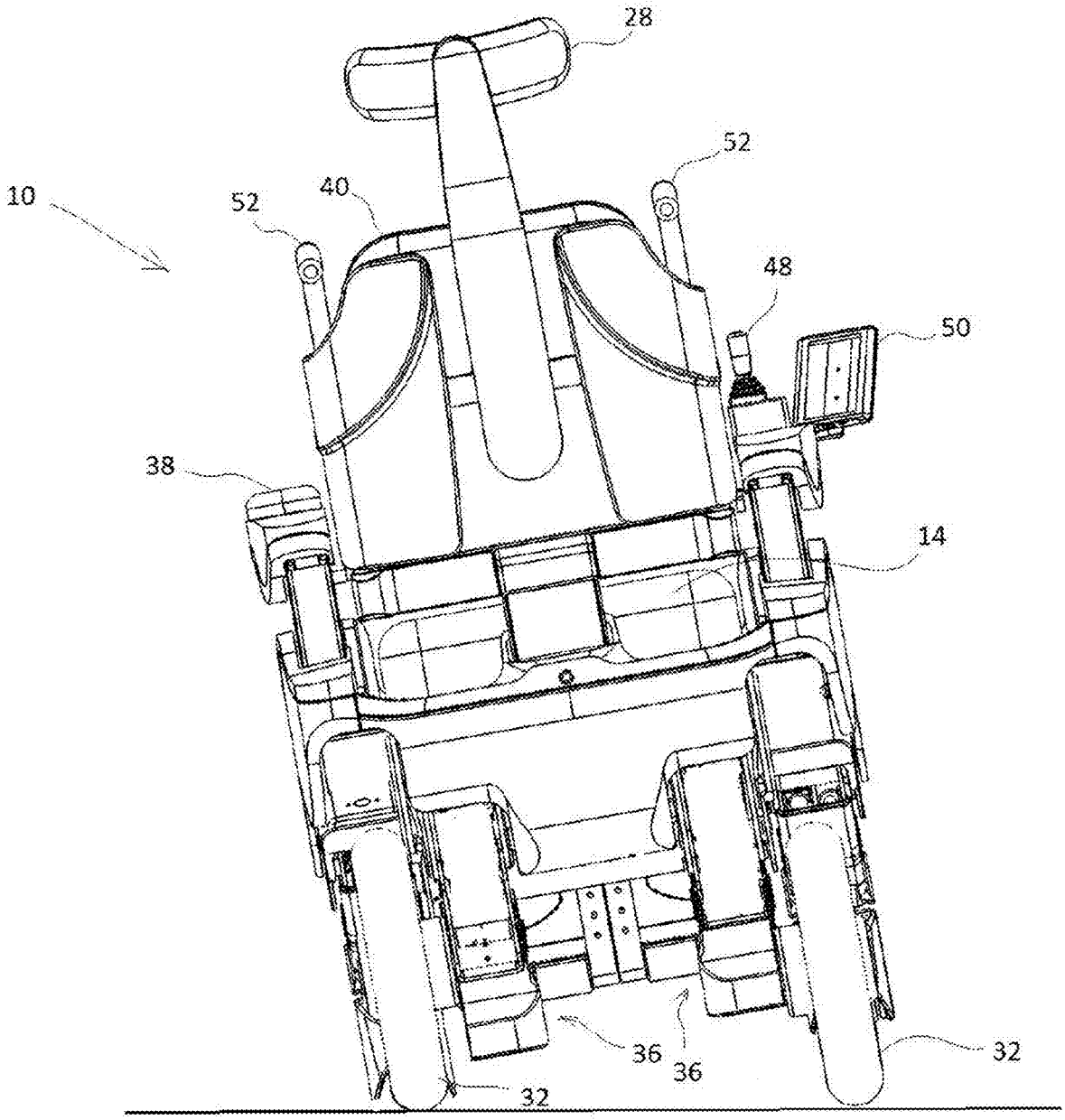
FIG. 23 is a side view of the assistive device of FIG. 1 in a left lateral tilt configuration.

Referring to FIG. 22 and FIG. 23, the assistive device 10 is shown in a right and left lateral tilt configurations, respectively. To configure the assistive device 10 in either the right or the left lateral tilt configuration, the control system (not shown), in response to receipt of selection of a selectable button associated with the right or the left lateral tilt configuration, independently controls the front leg mechanism 34 and the rear leg mechanism 36 located proximate the left side 24 of the platform 12 to open the front leg mechanisms 34 and rear leg mechanisms 36 to move the platform 12 relative to the front wheel 30 and rear wheel 32 coupled to the front leg mechanisms 34 and the rear leg mechanism 36, respectively, to laterally tilt the assistive device 10 to the right (FIG. 22) or the left (FIG. 23) to help a user (e.g. a person sitting on the seat cushion 14) roll out of device 10.

In some embodiments, the control system (not shown) periodically changes the configuration of the assistive device 10 (e.g. for example every 15-20 minutes) between one or more of the anterior tilt configuration, posterior tilt configuration, the left lateral tilt configuration, and the right lateral tilt configuration to reposition a user (e.g. a person sitting on the seat cushion 14) to avoid stress on the user's skin and to minimize pressure on vulnerable areas of the user.

It will be appreciated that in alternative embodiments, to configure the assistive device 10 is the lateral tilt configuration, the control system (not shown), in response to receipt of selection of a selectable symbol associated with the lateral tilt configuration independently controls the front leg mechanism 34 and the rear leg mechanism 36 located proximate the right side 26 of the platform 12 to open the front leg mechanism 34 and the rear leg mechanism 36 located proximate the right side 26 of the platform 12 to move the platform 12 relative to the front wheel 30 and rear wheel 32 coupled to the front leg mechanisms 34 and the rear leg mechanism 36 located proximate the right side 26 of the platform 12 to laterally tilt the assistive device 10 to the right.

Although the assistive device 10 shown in FIG. 1 to FIG. 23 includes four wheels and four independently controllable leg mechanisms, in alternative embodiments, the assistive device 10 includes three wheels and three independently controllable leg mechanisms. In this embodiment, the three wheels include one front wheel 30 and two rear wheels 32 or two front wheels 30 and one rear wheel, and three independently controllable leg mechanisms include one front leg mechanism 34 and two rear leg mechanisms 36. In other alternative implementations, the assistive device 10 includes more than three wheels and more than three independently controllable leg mechanisms.

In still other alternative embodiments, the control panel 50 and the joystick 48 may be omitted and the control system (not shown) may be in communication with a remote control (not shown) that is utilized to control the control system to configure the assistive device 10 into any one of the plurality of configurations and/or to control the drive mechanism to drive the assistive device 10.

In still other alternative embodiments, the assistive device 10 may include two front caster wheels, two rear caster wheels, and two mid wheels disposed between the front wheels and the rear wheels. In this embodiment, an independent leg mechanism is coupled to the platform and each of the front wheels, the mid wheels, and the rear wheels. Each independent leg mechanism configured to move the platform relative to the respective wheel to configure the assistive device into one of a plurality of configurations to position the platform at an elevation and inclination relative at a horizontal.

The assistive device 10 of the present disclosure provides a single device allows a person, such as a mobility impaired or elderly person, to execute different activities independently or with little assistance without comprising safety and maneuverability. The assistive device 10 of the present disclosure has enhanced stability when traversing rough and inclined surfaces due to the ability to self-level and adjust the ground clearance of the frame.

In the preceding description, for purposes of explanation, numerous details are set forth in order to provide a thorough understanding of the embodiments. However, it will be apparent to one skilled in the art that these specific examples only. Alterations, modifications and variations can be effected to the particular embodiments by those of skill in the art without departing from the scope, which is defined solely by the claims appended hereto.

What is claimed is:

1. An assistive device comprising:

a platform;

at least three wheels; and, at least three independent leg mechanisms, each respective leg mechanism of the at least three independent leg mechanisms coupled to the platform and a respective one of the at least three wheels, each respective leg mechanism configured to move the platform independently and relative to the respective wheel for positioning the platform at an elevation and for inclining the platform to an inclination to configure the assistive device into one of a plurality of configurations; and wherein each respective leg mechanism comprises a top link coupled to the platform and a bottom link rotationally connected to the top link and wherein each bottom link of each respective leg mechanism is coupled to the respective wheel so that each wheel moves vertically and independently relative to each of the other leg mechanisms.

2. The assistive device of claim 1, wherein each respective leg mechanism comprises a motor to independently open each respective leg mechanism to increase a distance between the platform and the respective wheel, and to independently close to reduce the distance between the platform and the respective wheel; and wherein each motor is coupled to engage the top link and the bottom link of each respective leg mechanism and pivot the bottom link relative to the top link.

3. The assistive device of claim 2, further comprising:

a control system configured to independently control the motor of at least three independent leg mechanisms for positioning the platform at the elevation and for inclining the platform to the inclination by controlling a distance between the platform and each respective wheel of the at least three wheels.

4. The assistive device of claim 3, wherein the assistive device further includes a gyroscopic sensor configured to detect a change in a position of the platform, and wherein the control system is further configured to move one or more of the at least three independent leg mechanisms to self-level the assistive device while ascending or descending an inclined surface.

5. The assistive device of claim 1, wherein the at least three wheels include a front wheel and two rear wheels and wherein the maximum number of wheels of the assistive device is four.

6. The assistive device of claim 5, wherein the front wheel is a caster wheel and the two rear wheels are drive wheels.

7. The assistive device of claim 1, wherein the at least three independent leg mechanisms comprise:

a front leg mechanism coupled to a front wheel and configured to move at least one of a front of the platform, a first side of the platform, and a second side of the platform opposing the first side of the platform relative to the front wheel and wherein a first motor pivots the bottom link of the front leg mechanism relative to the top link of the front leg mechanism to move the platform relative to the front wheel;

a first rear leg mechanism coupled to a first rear wheel of two rear wheels, the first rear leg mechanism configured to move at least one of a back of the platform, and the first side of the platform relative to the first rear wheel and wherein a second motor pivots the bottom link of the first rear leg mechanism relative to the top link of the first rear leg mechanism to move the platform relative to the first rear wheel; and a second rear leg mechanism coupled to a second rear wheel of the two rear wheels, the second rear leg mechanism configured to move at least one of the back of the platform, and the second side of the platform relative to the second rear wheel and wherein a third motor pivots the bottom link of the second rear leg mechanism relative to the top link of the second rear leg mechanism to move the platform relative to the second rear wheel.

8. The assistive device of claim 1, wherein the at least three wheels include two front wheels and two rear wheels.

9. The assistive device of claim 8, wherein the front wheels are caster wheels and the two rear wheels are drive wheels.

10. The assistive device of claim 9, wherein the at least three independent leg mechanisms comprise:

a first front leg mechanism coupled to a first front wheel of the two rear wheels, the first front leg mechanism configured to move at least one of a front of the platform, and a first side of the platform relative to the first front wheel;

a second front leg mechanism coupled to a second front wheel of the two rear wheels, the second front leg mechanism configured to move at least one of the front of the platform, and a second side of the platform opposing the first side relative to the second front wheel;

a first rear leg mechanism coupled to a first rear wheel of the two rear wheels, the first rear leg mechanism configured to move at least one of a back of the platform, and the first side of the platform relative to the first rear wheel; and a second rear leg mechanism coupled to a second rear wheel of the two rear wheels, the second rear leg mechanism configured to move at least one of the back of the platform, and the second side of the platform relative to the second rear wheel.

11. The assistive device of claim 1, further comprising: a seat cushion mounted to the platform.

12. The assistive device of claim 11, further comprising:

a backrest attached to the platform proximate a back of the platform for supporting a back of a user when the user is seated on the seat cushion.

13. The assistive device of claim 12, wherein the backrest is pivotally attached to the platform and moveable between a collapsed position in which a front face of the backrest lies on the seat cushion, and a fully-flat position in which the backrest is substantially horizontal and extends from the seat cushion.

14. The assistive device of claim 11, further comprising:

a leg rest assembly attached to a front of the platform for supporting legs of a user when the user is seated on the seat cushion.

15. The assistive device of claim 14, wherein the leg rest assembly is pivotally attached to the front of the platform and moveable between a first position in which the leg rest assembly extends substantially vertically from a bottom of the platform and a second position in which the leg rest assembly extends substantially horizontally from a front of the platform.

16. The assistive device of claim 15, wherein the leg rest assembly comprises a foot rest for supporting at least one foot of the user when the user is seated on the seat cushion.

17. The assistive device of claim 16, wherein the leg rest assembly further comprises one or more calf supports coupled to the foot rest, each of the one or more calf supports configured to support a calf of a leg of the user when the user is seated on the seat cushion.

18. The assistive device of claim 11, further comprising at least one armrest mounted to the platform for supporting an arm of a user.

19. The assistive device of claim 18, wherein the at least one armrest comprises a pair of collapsible armrests including a first collapsible armrest mounted to a top of the platform proximate a left side of the platform, and a second collapsible armrest mounted to the top of the platform proximate a right side of the platform.

20. The assistive device of claim 1, wherein the top link of each respective leg mechanism is pivotally connected to the bottom link of each respective leg mechanism with a pivot point thereby allowing the top link of each respective leg mechanism to pivot relative to the bottom link of each respective leg mechanism; and wherein each leg mechanism of the at least three independent leg mechanisms is configured to pivot independently from each other.

* * * * *